US011072977B2

(12) United States Patent
Koizumi et al.

(10) Patent No.: US 11,072,977 B2
(45) Date of Patent: Jul. 27, 2021

(54) TWO-PISTON HYDRAULIC STRIKING DEVICE

(71) Applicant: Furukawa Rock Drill Co., Ltd., Tokyo (JP)

(72) Inventors: Masahiro Koizumi, Takasaki (JP); Toshio Matsuda, Takasaki (JP)

(73) Assignee: Furukawa Rock Drill Co., Ltd., Tokyo (JP)

( * ) Notice: Subject to any disclaimer, the term of this patent is extended or adjusted under 35 U.S.C. 154(b) by 196 days.

(21) Appl. No.: 16/313,314

(22) PCT Filed: Jun. 22, 2017

(86) PCT No.: PCT/JP2017/023098
§ 371 (c)(1),
(2) Date: Dec. 26, 2018

(87) PCT Pub. No.: WO2018/003668
PCT Pub. Date: Jan. 4, 2018

(65) Prior Publication Data

US 2020/0181978 A1 Jun. 11, 2020

(30) Foreign Application Priority Data

Jun. 28, 2016 (JP) ..... JP2016-127933

(51) Int. Cl.
*E21B 1/00* (2006.01)
*B25D 9/12* (2006.01)
(Continued)

(52) U.S. Cl.
CPC ..... *E21B 1/00* (2013.01); *B25D 9/12* (2013.01); *B25D 9/26* (2013.01); *B25D 9/145* (2013.01);
(Continued)

(58) Field of Classification Search
CPC . B25D 9/12; B25D 9/26; B25D 9/145; B25D 9/18; B25D 2209/005;
(Continued)

(56) References Cited

U.S. PATENT DOCUMENTS 4,070,949 A * 1/1978 Salmi ..... B25D 9/20 91/276
4,342,255 A 8/1982 Watanabe et al.
(Continued)

FOREIGN PATENT DOCUMENTS

DE 830332 C 2/1952
DE 3025571 A1 2/1982
(Continued)

OTHER PUBLICATIONS

Extended European Search Report in corresponding European Patent Applicatoin No. 17820025.9, dated Jun. 4, 2019, 15 pgs.
(Continued)

*Primary Examiner* — Robert F Long
*Assistant Examiner* — Xavier A Madison
(74) *Attorney, Agent, or Firm* — Young Basile Hanlon & MacFarlane, P.C.

(57) ABSTRACT

Provided is a two-piston hydraulic striking device that has stable operativity. This two-piston hydraulic striking device includes two striking mechanisms for striking one transfer member. Each striking mechanism has a pressure receiving area ratio between the front and rear of a piston thereof set in such a way that the two striking mechanisms have the same cycle time.

20 Claims, 15 Drawing Sheets

(51) Int. Cl.
*B25D 9/26* (2006.01)
*B25D 9/14* (2006.01)
*B25D 9/18* (2006.01)

(52) U.S. Cl.
CPC ..... *B25D 9/18* (2013.01); *B25D 2209/002* (2013.01); *B25D 2209/005* (2013.01); *B25D 2217/0023* (2013.01); *B25D 2222/72* (2013.01); *B25D 2250/125* (2013.01)

(58) Field of Classification Search
CPC .... B25D 2217/0023; B25D 2217/0026; B25D 2250/125; B25D 2222/72; B25D 2209/002; E21B 1/00
USPC ..... 173/208
See application file for complete search history.

(56) References Cited

U.S. PATENT DOCUMENTS

| | | | | |
|---|---|---|---|---|
| 4,825,960 | A * | 5/1989 | Krone | B25D 9/12 173/51 |
| 10,150,209 | B2 * | 12/2018 | Matsuda | B25D 9/26 |
| 10,493,610 | B2 * | 12/2019 | Koizumi | B25D 9/12 |
| 2004/0251038 | A1 * | 12/2004 | Rantala | B25D 9/18 173/207 |
| 2008/0296035 | A1 | 12/2008 | Lohmann et al. | |
| 2010/0051348 | A1 * | 3/2010 | Andersson | E21B 1/02 175/57 |
| 2015/0068782 | A1 * | 3/2015 | Mellwig | B25D 9/14 173/90 |
| 2016/0144498 | A1 * | 5/2016 | Muuttonen | B25D 9/18 91/303 |

FOREIGN PATENT DOCUMENTS

| | | | |
|---|---|---|---|
| FR | 642343 | A | 8/1928 |
| JP | S53-009203 | A | 1/1978 |
| JP | S58-016992 | A | 1/1983 |
| JP | S61-025784 | A | 2/1986 |
| JP | H10-025769 | A | 1/1998 |
| JP | 2005-507789 | A | 3/2005 |
| JP | 4942652 | B2 | 5/2012 |
| JP | 2015-163426 | A | 9/2015 |

OTHER PUBLICATIONS

Korean Office Action in corresponding Korean Patent Application No. 10-2018-7037927, dated May 29, 2020, and a machine-language English translation, 18 pgs.
English translation of International Preliminary Report on Patentability in PCT/US2017/023098, dated Jan. 10, 2019, 16 pgs.
Japanese Office Action in corresponding Japanese Patent Application No. 2018-525123, dated May 11, 2021, and machine-language English translation, 22 pgs.

* cited by examiner

TWO-PISTON HYDRAULIC STRIKING DEVICE

TECHNICAL FIELD

The present invention relates to a hydraulic striking device, such as a rock drill and a breaker, for crushing bedrock and the like by delivering blows to a tool, such as a rod and a chisel.

BACKGROUND

For example, a rock drill includes a rock drill main body that has a striking mechanism. A shank rod is inserted into a front end portion of the rock drill main body, and a rod having a bit for drilling attached thereto is connected to the shank rod by means of a sleeve. The rock drill main body is configured in such a way that, when a piston of the striking mechanism strikes the shank rod, striking energy of the strike is transferred from the shank rod to the bit by way of the rod and the bit can penetrate and crush bedrock, which is a crushing target.

In a hydraulic striking device of this type, improvement in output power of a striking mechanism is a problem for which many companies including the applicant have constantly sought a solution. Approaches for achieving high output power include a measure of increasing striking energy per strike, a measure of increasing the number of strikes, and a case of performing both measures collectively.

When striking energy per strike is increased, stress exerted on a transfer member that is made up of a shank rod, a rod, and a bit increases. In addition, striking energy that cannot be fully consumed in crushing of bedrock is transferred to the rock drill as reflected energy. The reflected energy increases in proportion to striking energy. For this reason, stress exerted on the rock drill main body also increases. Therefore, the measure of increasing striking energy per strike can be said to be effective if an improvement in strength matching an increase in stress exerted on the rock drill main body can be attained.

Meanwhile, a hydraulic striking device of this type is generally provided with a stroke adjuster. A stroke adjuster has a structure that changes a stroke of a piston to a short stroke by expediting operation timing of a switching valve that controls the striking mechanism. When a short stroke setting is selected by operating the stroke adjuster, the stroke of the piston is shortened and the number of strikes increases.

However, acceleration time of the piston is also shortened in association with shortening of the stroke of the piston. For this reason, piston speed is reduced and an increase in output power of the striking mechanism cannot thus be achieved. Therefore, the stroke adjuster is mainly used as a means for reducing striking output when drilling work targeting unstable bedrock including a lot of crushed zones is carried out.

For example, JP 2005-507789 A proposes a striking mechanism 10 that, by including two pistons 1 and 2, doubles the number of strikes, as exemplified in FIG. 14. In the striking mechanism 10 described in JP 2005-507789 A, one hollow piston 1 has a hollow shape and the other solid piston 2 has a solid shape. The two pistons 1 and 2 are coaxially disposed inside a cylinder 3 and therewith arranged in such a way that the solid piston 2 is inserted through the bore of the hollow piston 1. A front chamber 1*m* and a rear chamber 1*u* are defined in the front and rear of the hollow piston 1, and a front chamber 2*m* and a rear chamber 2*u* are defined in the front and rear of the solid piston 2.

A hollow piston control port Pf and an oil discharge port Pt are disposed in this order from the front between the front chamber 1*m* and the rear chamber 1*u* of the hollow piston 1, and, therewith, a solid piston control port Pr is disposed between the front chamber 2*m* and the rear chamber 2*u* of the solid piston 2. Further, the striking mechanism 10 includes a switching valve mechanism 4 into which a switching valve 4*d* is incorporated as a control means for controlling advancing and retracting movements of the two pistons 1 and 2. The switching valve 4*d* is configured in such a way that the switching valve 4*d* is constantly biased in one direction (the left direction in FIG. 14) and, therewith, when pressurized oil is supplied to the valve control ports Pf and Pr, the switching valve 4*d* is switched in the opposite direction (the right direction in FIG. 14) against the biasing force and the two pistons 1 and 2 alternately strike a rear portion of one transfer member 20 in accordance with supply and discharge of pressurized oil to and from the front and rear chambers of the two pistons 1 and 2.

An operation explanatory diagram of the striking mechanism 10 described above is illustrated in FIGS. 15A to 15D. Note that, in FIGS. 15A to 15D, a shaded area indicates that the area is connected to high pressure and a blank area indicates that the area is connected to low pressure. Switching timings of the switching valve mechanism 4 are as follows:

(1) retraction timing of switching valve (FIGS. 15A and 15B)

a timing at which, while the hollow piston 1 and the solid piston 2 are in a retraction phase and an advance phase, respectively, first, the hollow piston control port Pf is closed by a piston large diameter portion 1*d* due to retraction of the hollow piston 1 and, next, the front chamber 2*m* comes into communication with the solid piston control port Pr due to advance of the solid piston 2; and (2) advance timing of switching valve (FIGS. 15C and 15D)

a timing at which, while the solid piston 2 and the hollow piston 1 are in a retraction phase and an advance phase, respectively, first, the communication between the front chamber 2*m* and the solid piston control port Pr is closed due to retraction of the solid piston 2 and, next, the hollow piston control port Pf comes into communication with the oil discharge port Pt due to advance of the hollow piston 1.

Even if, at the retraction timing of the switching valve described in the above item (1), after the front chamber 2*m* has come into communication with the solid piston control port Pr due to the advance of the solid piston 2, the hollow piston control port Pf is closed by the piston large diameter portion 1*d* due to the retraction of the hollow piston 1, the striking mechanism 10 does not work normally because pressurized oil is unloaded.

Similarly, even if, at the advance timing of the switching valve described in the above item (2), before the communication between the front chamber 2*m* and the solid piston control port Pr is closed due to the retraction of the solid piston 2, the hollow piston control port Pf comes into communication with the oil discharge port Pt due to the advance of the hollow piston 1, the striking mechanism 10 does not work normally because the pressurized oil is unloaded.

Since, as described above, in the striking mechanism 10, not only open/close states of ports in association with advancing and retracting movements of both the two pistons 1 and 2 but also a sequence of openings and closings of the ports is strictly used in the control of the switching valve mechanism 4, it can be said that the control is an ideal control for making the two pistons 1 and 2 perform alternate strikes accurately.

BRIEF SUMMARY

However, in the striking mechanism described in JP2005-507789, there is a problem in that operation thereof is unstable because the striking mechanism comes not to operate accurately when an abnormality occurs in operation speed of either piston due to influence from repulsive force from bedrock and the like or when a striking position of either piston has moved due to a change in a penetration state of the bit into the bedrock.

In addition, the striking mechanism described in JP2005-507789 is incapable of operating in a strike mode other than alternate strikes, such as a single piston strike mode and a simultaneous strike mode. Note that the "single piston strike mode" refers to a strike mode in which one piston is stopped and striking is performed using only the other piston. Note also that the "simultaneous strike mode" is a measure for increasing striking energy per strike and refers to a strike mode in which two pistons strike a transfer member simultaneously.

Further, in the striking mechanism described in JP2005-507789, it is substantially difficult to shorten a piston stroke by providing the striking mechanism with a stroke adjuster. In the striking mechanism described in JP2005-507789, there is also a problem in that hydraulic efficiency is reduced because the striking mechanism has a structure that cannot prevent ports 18 and 19 opening in the rear chamber 1*u* of the hollow piston 1 (see FIG. 14) from momentarily communicating with each other while one port is connected to high pressure and the other port is connected to low pressure.

Accordingly, the present invention has been made in view of such problems, and an object of the present invention is to provide a two-piston hydraulic striking device that has stable operatively.

In order to achieve the object mentioned above, according to one aspect of the present invention, there is provided a two-piston hydraulic striking device including a striking mechanism configured to strike a transfer member with two pistons, wherein the striking mechanism includes a first striking mechanism and a second striking mechanism, and the first striking mechanism and the second striking mechanism are arranged in series in front and rear direction in such a way that striking axes are coaxial with each other and the second striking mechanism is positioned on a side where the transfer member is located, the first striking mechanism includes: a first cylinder; a first piston configured to be slidably fitted into the first cylinder in such a manner as to be able to advance and retract, the first piston having a first striking portion for striking the transfer member at a tip portion of the first piston; and a first switching valve configured to switch advancing and retracting movements of the first piston, the second striking mechanism includes: a second cylinder; a second piston configured to be slidably fitted into the second cylinder in such a manner as to be able to advance and retract, the second piston having a second striking portion for striking the transfer member at a tip portion of the second piston; and a first switching valve configured to switch advancing and retracting movements of the second piston, only either the first striking mechanism or the second striking mechanism includes a valve controller for controlling operation of both the first switching valve and the second switching valve, of the two pistons, at least the second piston is formed into a hollow shape and the first piston is inserted into inside of the second piston in such a way that the first striking portion extends in such a manner as to be able to strike the transfer member, and each of the two pistons has a pressure receiving area ratio between front and rear of the piston set to satisfy a formula below: $[t1a+t1c]=t1b=[t2a+t2c]=t2b$ . . . (Formula), where t1a, t1b, t1c, t2a, t2b, and t2c represent an advance time of the first piston, a retraction acceleration time of the first piston, a retraction deceleration time of the first piston, an advance time of the second piston, a retraction acceleration time of the second piston, and a retraction deceleration time of the second piston, respectively.

According to the two-piston hydraulic striking device according to the one aspect of the present invention, it is possible to strike the transfer member with both the first piston and the second piston because the first piston and the second piston are arranged in such a way that the striking axes thereof are coaxial with each other, and switching of advancing and retracting movements of the two pistons is respectively performed by individual switching valves for the two pistons and operation of the two switching valves is controlled by one valve controller. In other words, the valve controller, which is a sole valve controller as a means for controlling operation of the first switching valve and a means for controlling operation of the second switching valve, is disposed to only either the first striking mechanism or the second striking mechanism. Since each of the two pistons has a pressure receiving area ratio between the front and rear of the piston set to satisfy the above formula, the two striking mechanisms have the same cycle time and are easy to control and stable in operation.

In the two-piston hydraulic striking device according to the one aspect of the present invention, the striking mechanisms are preferably configured in such a manner as to be able to set an alternate strike mode in which the two pistons alternately strike the one transfer member, and the alternate strike mode is a mode in which a switching port of the first switching valve and a switching port of the second switching valve are set in such a way as to have opposite phases to each other and the first striking mechanism and the second striking mechanism operate in such a way as to alternately strike the transfer member at equal temporal intervals.

Since such a configuration causes the switching ports of the first switching valve and the second switching valve to be set in such a way as to have opposite phases to each other and the first striking mechanism and the second striking mechanism to operate in the alternate strike mode, in which the first striking mechanism and the second striking mechanism alternately strike the transfer member at equal temporal intervals, while the number of strikes doubles and the sum of striking energy is increased when compared with a case where striking is performed with a single striking mechanism, vibration can be reduced because, in the respective striking mechanisms, strike reaction forces to the respective striking mechanisms offset each other.

Further, in the two-piston hydraulic striking device according to the one aspect of the present invention, the striking mechanisms are preferably configured in such a manner as to be able to set a simultaneous strike mode in which the two pistons simultaneously strike the one transfer member, and the simultaneous strike mode is a mode in which a switching port of the first switching valve and a switching port of the second switching valve are set in such a way as to have a same phase as each other and the first striking mechanism and the second striking mechanism operate in such a way as to simultaneously strike the transfer member.

Since such a configuration causes the switching ports of the first switching valve and the second switching valve to be set in such a way as to have the same phase as each other and the first striking mechanism and the second striking mechanism to operate in the simultaneous strike mode, in which the first striking mechanism and the second striking mechanism simultaneously strike the transfer member, striking energy per strike takes a value obtained by adding striking energy of the first piston and striking energy of the second piston. Thus, the striking energy per strike doubles, and the simultaneous strike mode is thus effective in a case where a crushing target is hard rock.

Further, in the two-piston hydraulic striking device according to the one aspect of the present invention, the striking mechanisms preferably have, at either the first switching valve or the second switching valve, an operation mode selector for selecting an alternate strike mode or a simultaneous strike mode by switching phases of a switching port of each switching valve, the alternate strike mode is a mode in which the two pistons alternately strike the one transfer member, and the simultaneous strike mode is a mode in which the two pistons simultaneously strike the one transfer member.

Since such a configuration has, at either the first switching valve or the second switching valve, an operation mode selector disposed for selecting the alternate strike mode or the simultaneous strike mode by switching phases of a switching port, the configuration is suitable for performing drilling work selecting an optimum strike mode suitable for a crushing target, such as selecting the alternate strike mode in a case where the crushing target is soft rock and selecting the simultaneous strike mode in a case where the crushing target is hard rock.

Further, in the two-piston hydraulic striking device according to the one aspect of the present invention, at least a switching valve that is controlled by the operation mode selector is preferably a fully hydraulically actuated pilot control valve that includes a control port configured to be supplied with control pressure and a hold port configured to be supplied with hold pressure from the valve controller, and the operation mode selector preferably includes a control pressure switching valve configured to switch phases of the switching port by switching arrangements of the control port and the hold port.

Since such a configuration causes at least a switching valve that is controlled by the operation mode selector to be a fully hydraulically actuated pilot control valve that includes a control port configured to be supplied with control pressure and a hold port configured to be supplied with hold pressure from the valve controller and the operation mode selector to switch phases of the switching port by switching arrangements of the control port and the hold ports, a configuration of components on passages from the high pressure circuit to the piston rear chambers does not have to be changed and pressure loss never occurs.

Further, in the two-piston hydraulic striking device according to the one aspect of the present invention, the operation mode selector preferably includes a circuit switching valve configured to switch phases of the switching port by switching circuit configurations of a high pressure circuit and a low pressure circuit that are connected to a switching valve that is controlled by the operation mode selector.

Since such a configuration causes the operation mode selector to include a circuit switching valve configured to switch phases of the switching port by switching circuit configurations of the high pressure circuit and the low pressure circuit that are connected to a switching valve that is controlled by the operation mode selector, the configuration is suitable for simplifying a component configuration.

Further, in the two-piston hydraulic striking device according to the one aspect of the present invention, either one of the first switching valve and the second switching valve preferably has a stopper for stopping operation of the either one of the first switching valve and the second switching valve by cutting off a connection between the valve controller and a control port of the either one of the first switching valve and the second switching valve and is preferably configured in such a manner as to be able to select a single piston strike mode in which striking is performed by either the first striking mechanism or the second striking mechanism.

Since such a configuration has, to either one of the first switching valve or the second switching valve, a stopper disposed for stopping operation of the switching valve by cutting off a connection between the valve controller and the control port of the switching valve and enables a single piston strike mode in which striking is performed by only either the first striking mechanism or the second striking mechanism to be selected, it becomes possible to perform so-called "light strikes" that halve the number of strikes with respect to the alternate strike mode and halve striking energy with respect to the simultaneous strike mode, and the configuration is suitable for increasing versatility of drilling work.

Further, in the two-piston hydraulic striking device according to the one aspect of the present invention, the stopper preferably has a selection valve configured to switch stop positions of the either one of the first switching valve and the second switching valve in such a way as to maintain a piston rear chamber of a striking mechanism to be stopped at either high pressure or low pressure.

Since such a configuration includes a selection valve configured to switch stop positions of the switching valve in such a way as to maintain the piston rear chamber of a striking mechanism to be stopped at either high pressure or low pressure, connecting the rear chamber of the piston to be stopped to high pressure and stopping the piston cause the piston to push the transfer member forward and stop. Since the stop of one piston causes the other piston to operate in the single piston strike mode at an advanced position in which the other piston strikes the transfer member at a position advanced beyond an impact point, it becomes possible to select, in addition to the above-described "light strikes", "small strikes" the striking energy of which is further reduced than that of the "light strikes", and the configuration is thus suitable for further increasing versatility of the drilling work.

Further, in the two-piston hydraulic striking device according to the one aspect of the present invention, the stopper preferably has a stopping thrust adjuster for, when the striking mechanism to be stopped is stopped with a piston rear chamber of the striking mechanism connected to high pressure, adjusting pressure in the piston rear chamber of the striking mechanism to be stopped in such a way that forward thrust of a piston of the striking mechanism to be stopped is less than or equal to thrust of a feed mechanism.

Since such a configuration has a stopping thrust adjuster disposed for, when a striking mechanism is stopped with the piston rear chamber of the striking mechanism connected to high pressure, adjusting pressure in the piston rear chamber in such a way that forward thrust of the piston is less than or equal to thrust of a feed mechanism, the amount of penetration of the transfer member can be changed according to a state of a crushing target when the above-described "small strikes" are performed, and the configuration is thus more suitable for making striking energy optimally controllable.

Further, in the two-piston hydraulic striking device according to the one aspect of the present invention, mass of the first piston and mass of the second piston is preferably set to be the same. Since such a configuration causes the mass of the first piston and the mass of the second piston to be set to be the same, striking energy of the first striking mechanism and striking energy of the second striking mechanism become the same. Thus, when striking energy per strike is set to be less than a fatigue limit of the transfer member, even operation in the alternate strike mode does not cause fatigue failure. In addition, offset effect between strike reaction forces becomes maximum.

Further, in the two-piston hydraulic striking device according to the one aspect of the present invention, at at least a point in control passages of the first switching valve and the second switching valve, an adjuster for adjusting operation speed of a switching valve is preferably disposed.

Since such a configuration has, at least a point in control passages of the first switching valve and the second switching valve, an adjuster disposed for adjusting operation speed of a switching valve, it is possible to perform alternate strikes in which intervals between all successive strikes are temporally equally spaced when the two-piston hydraulic striking device operates in the "alternate strike mode" and perform accurate simultaneous strikes when the two-piston hydraulic striking device operates in the "simultaneous strike mode".

Further, in the two-piston hydraulic striking device according to the one aspect of the present invention, the valve controller preferably includes a first piston advance control port configured to communicate the high pressure circuit with a valve control passage in association with a retraction of the first piston, and a first piston retraction control port configured to communicate the low pressure circuit with the valve control passage in association with an advance of the first piston, and a stroke adjustment mechanism is preferably disposed to the first piston advance control port.

Since such a configuration causes the valve controller to include a first piston advance control port configured to communicate the high pressure circuit with a valve control passage in association with a retraction of the first piston and a first piston retraction control port configured to communicate the low pressure circuit with the valve control passage in association with an advance of the first piston and a stroke adjustment mechanism to be disposed to the first piston advance control port, the strokes of the first striking mechanism and the second striking mechanism can be changed simultaneously, and it becomes possible to perform drilling work suitable for a crushing target.

In the two-piston hydraulic striking device according to the one aspect of the present invention, each of the first striking mechanism and the second striking mechanism preferably include a high pressure accumulator and a low pressure accumulator. Since such a configuration causes each of the first striking mechanism and the second striking mechanism to include a high pressure accumulator and a low pressure accumulator, the piston rear chamber and the accumulator of each striking mechanism can be arranged in proximity to each other. Thus, since it becomes possible to buffer pulsation of pressurized oil and accumulate and convert surplus pressurized oil to striking energy, striking efficiency is increased.

Further, in order to achieve the object mentioned above, according to another aspect of the present invention, there is provided a two-piston hydraulic striking device including a striking mechanism configured to strike one or a plurality of transfer members with two pistons, wherein the striking mechanism includes a first striking mechanism and a second striking mechanism, and the first striking mechanism and the second striking mechanism are arranged in such a way that striking axes are in parallel with each other, the first striking mechanism includes: a first cylinder; a first piston configured to be slidably fitted into the first cylinder in such a manner as to be able to advance and retract, the first piston having a first striking portion for striking the transfer member at a tip portion of the first piston; and a first switching valve configured to switch advancing and retracting movements of the first piston, the second striking mechanism includes: a second cylinder; a second piston configured to be slidably fitted into the second cylinder in such a manner as to be able to advance and retract, the second piston having a second striking portion for striking the transfer member at a tip portion of the second piston; and a first switching valve configured to switch advancing and retracting movements of the second piston, only the first striking mechanism includes a valve controller for controlling operation of both the first switching valve and the second switching valve, and each of the two pistons has a pressure receiving area ratio between front and rear of the piston set to satisfy a formula below: $[t1a+t1c]=t1b=[t2a+t2c]=t2b$ . . . (Formula), where t1a, t1b, t1c, t2a, t2b, and t2c represent an advance time of the first piston, a retraction acceleration time of the first piston, a retraction deceleration time of the first piston, an advance time of the second piston, a retraction acceleration time of the second piston, and a retraction deceleration time of the second piston, respectively.

According to the two-piston hydraulic striking device according to another aspect, switching of advancing and retracting movements of the two pistons is respectively performed by individual switching valves for the two pistons and the valve controller, which is a sole valve controller as a means for controlling operation of the first switching valve and a means for controlling operation of the second switching valve, is disposed to only the first striking mechanism. Since each of the two pistons has a pressure receiving area ratio between the front and rear of the piston set to satisfy the above formula, the two striking mechanisms have the same cycle time and are easy to control and stable in operation. According to the two-piston hydraulic striking device according to the another aspect, in, for example, a hydraulic striking device for drilling a slotted hole, two striking mechanisms have the same cycle time, are easy to control and stable in operation, and are capable of offsetting strike reaction forces of each other.

As described above, according to the present invention, a two-piston hydraulic striking device that has stable operatively can be provided.

DETAILED DESCRIPTION

Hereinafter, embodiments and variations of a two-piston hydraulic striking device according to an aspect of the present invention will be described with reference to the drawings as appropriate. A basic configuration of a rock drill excluding a hydraulic striking device that will be described below is a known configuration similar to that of a conventional rock drill, and, in the basic configuration, a shank rod, which is one of transfer members, is inserted into a front end portion of a rock drill main body and a rod having a bit for drilling attached thereto is connected to the shank rod with a sleeve (illustration of both portions is omitted).

Note that the drawings are schematic. Therefore, it should be noted that a relation and ratio between thickness and planar dimensions, and the like are different from actual ones, and portions where dimensional relations and ratios among the drawings are different from one another are also included. In addition, the following embodiments and variations indicate, by way of example, devices and methods for embodying the technical idea of the present invention, and the technical idea of the present invention does not limit the materials, shapes, structures, arrangements, and the like of the constituent components to those described in the following embodiments and variations.

First Embodiment

Figure 1:
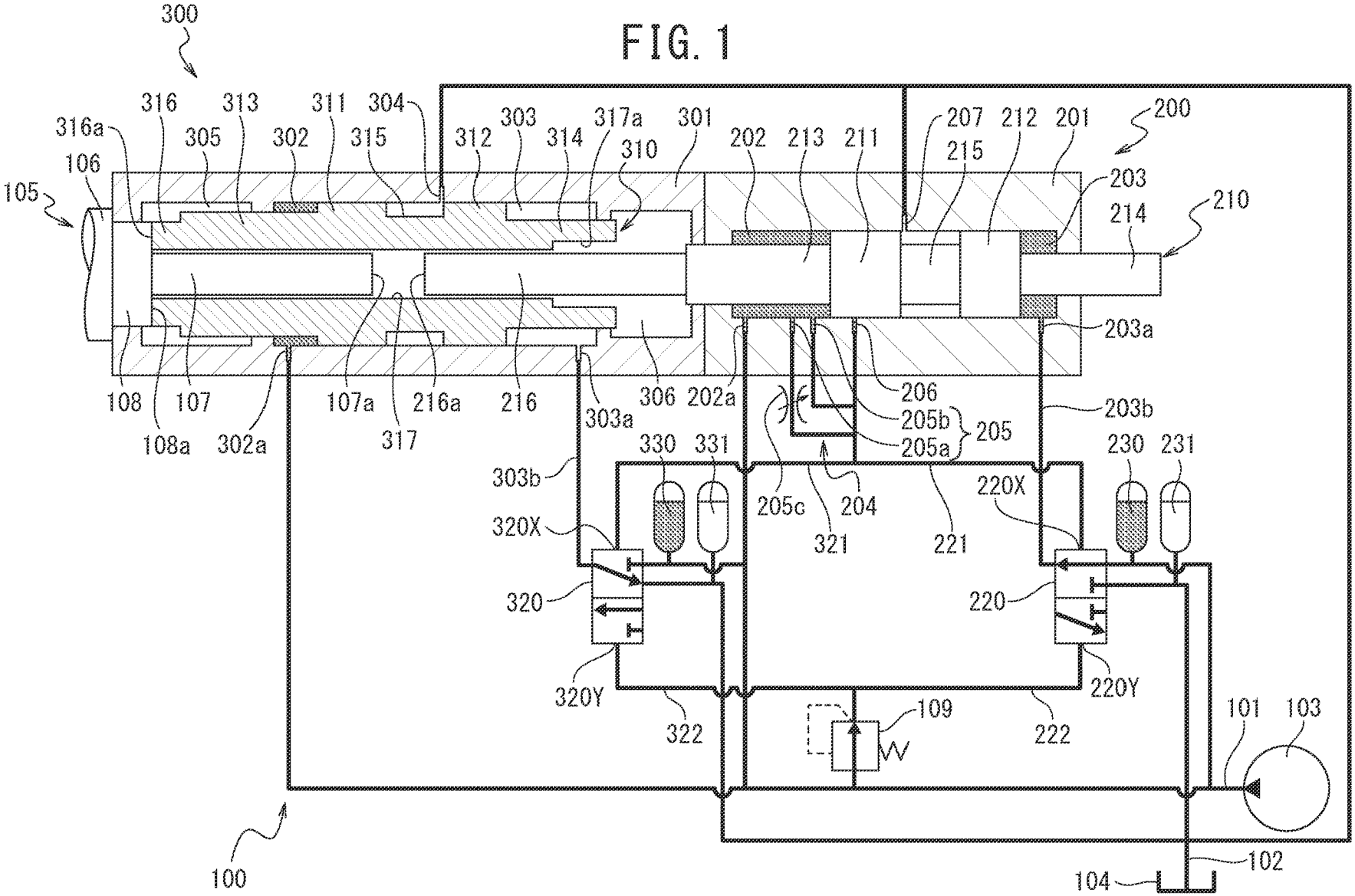
FIG. 1 is a longitudinal cross-sectional view of a first embodiment of a two-piston hydraulic striking device according to one aspect of the present invention.

A rock drill main body of a first embodiment includes a two-piston hydraulic striking device 100, as illustrated in FIG. 1. The two-piston hydraulic striking device 100 includes a high pressure circuit 101, a low pressure circuit 102, a pump 103, a tank 104, a transfer member 105, a decompression valve 109, a first striking mechanism 200, and a second striking mechanism 300.

The first striking mechanism 200 and the second striking mechanism 300 are arranged in series in the front and rear direction in such a way that the striking axes thereof are coaxial with each other and the second striking mechanism 300 is positioned on the side where the transfer member 105 is located. The decompression valve 109 is disposed in a passage that branches from the high pressure circuit 101 and is connected to hold ports 220Y and 320Y that a first switching valve 220 and a second switching valve 320, which will be described later, have, respectively, in such a manner as to be able to supply hold pressure to the hold ports 220Y and 320Y.

The transfer member 105 is disposed in front of a second cylinder 301, which will be described later. The transfer member 105 coaxially has a large diameter portion 106 that is formed into a solid cylindrical shape, a second striking portion 108 that has a smaller diameter than the large diameter portion 106 and is formed into a solid cylindrical shape, and a first striking portion 107 that has a smaller diameter than the second striking portion 108 and is formed into a solid cylindrical shape in this order from the front in the axial direction. The rear end surface of the first striking portion 107 and the annular rear end surface of the second striking portion 108 serve as a first striking surface 107*a* and a second striking surface 108*a*, respectively.

The first striking mechanism 200 includes a first cylinder 201, a first piston 210, the first switching valve 220, a first high pressure accumulator 230, a first low pressure accumulator 231, and a valve control means 204.

The first piston 210 has a solid cylindrical shape and is slidably fitted into the first cylinder 201 in such a manner as to be able to advance and retract. The first piston 210 coaxially has a first piston striking portion 216, a first piston medium diameter portion 213, a first piston large diameter portion (front) 211, a first piston switching groove 215, a first piston large diameter portion (rear) 212, and a first piston small diameter portion 214 in this order from the front in the axial direction. The front end surface of the first piston striking portion 216 serves as a first piston striking surface 216*a*, and the first piston striking surface 216*a* faces the first striking surface 107*a* of the transfer member 105 described above in the axial direction.

The first striking mechanism 200 includes a first piston front chamber 202 and a first piston rear chamber 203. The first piston front chamber 202 is defined between the first piston 210 and the first cylinder 201 in front of the first piston large diameter portion (front) 211. The first piston rear chamber 203 is defined between the first piston 210 and the first cylinder 201 in the rear of the first piston large diameter portion (rear) 212. In the first piston front chamber 202 and the first piston rear chamber 203, a first piston front chamber port 202*a* and a first piston rear chamber port 203*a* are opened, respectively.

The first piston front chamber port 202*a* is connected to the high pressure circuit 101. This configuration causes pressure in the first piston front chamber 202 to be constantly high. The first piston rear chamber port 203*a* is connected to the discharge side of the first switching valve 220 via a first piston rear chamber passage 203*b*. The first piston rear chamber port 203*a* is selectively connected to the high pressure circuit 101 and the low pressure circuit 102 in an alternate manner by switching operation of the first switching valve 220. This configuration causes pressure in the first piston rear chamber 203 to be switched between high and low. In a moving range of the first piston switching groove 215, a first piston oil discharge port 207 is opened. The first piston oil discharge port 207 is constantly connected to the low pressure circuit 102.

In the first cylinder 201, first piston advance control ports 205 and a first piston retraction control port 206 are opened in this order from the front, in separation from each other at predetermined intervals, and toward the rear side from the first piston front chamber port 202*a*. The first piston advance control ports 205 are made up of a short stroke port 205*a* on the front side and a long stroke port 205*b* on the rear side.

To the short stroke port 205*a*, a variable throttle 205*c* is connected. The first piston 210 is configured in such a way that operating the variable throttle 205*c* from full open to full close enables a stroke of the first piston 210 to be adjusted from a short stroke to a long stroke in a stepless manner. The first piston advance control ports 205 and the first piston retraction control port 206 constitute the valve control means 204.

The first switching valve 220 is a fully hydraulically actuated pilot control valve. The first switching valve 220 includes a control port 220X and the hold port 220Y and is configured to perform switching operation with hold pressure constantly supplied to the hold port 220Y and control pressure charged to and discharged from the control port 220X. The control port 220X and the hold port 220Y are connected to the valve control means 204 and the decompression valve 109 via a first switching valve control passage 221 and a first switching valve hold passage 222, respectively.

The first piston 210 has a diameter difference between the first piston large diameter portion (front) 211 and the first piston medium diameter portion 213 set to be smaller than a diameter difference between the first piston large diameter portion (rear) 212 and the first piston small diameter portion 214. Therefore, pressure receiving area of the first piston in the first piston front chamber 202 is smaller than pressure receiving area of the first piston in the first piston rear chamber 203. For this reason, when both the first piston front chamber 202 and the first piston rear chamber 203 are connected to the high pressure circuit 101, a pressure receiving area difference causes the first piston 210 to advance.

The second striking mechanism 300 includes the second cylinder 301, a second piston 310, the second switching valve 320, a second high pressure accumulator 330, and a second low pressure accumulator 331. The second piston 310 has a hollow cylindrical shape and is slidably fitted into the second cylinder 301 in such a manner as to be able to advance and retract.

The second piston 310, on the outer periphery thereof, coaxially has a second piston striking portion 316, a second piston medium diameter portion 313, a second piston large diameter portion (front) 311, a second piston middle groove 315, a second piston large diameter portion (rear) 312, and a second piston small diameter portion 314 in this order from the front in the axial direction.

The second piston 310, on the inner periphery thereof, coaxially has a second piston bore 317 and a second piston bore large diameter portion 317*a* in this order from the front in the axial direction. An annular surface formed at the front end of the second piston striking portion 316 serves as a second piston striking surface 316*a*. The second piston striking surface 316*a* faces the second striking surface 108*a* of the transfer member 105 described above in the axial direction.

The second striking mechanism 300 includes a second piston front chamber 302 and a second piston rear chamber 303. The second piston front chamber 302 is defined between the second piston 310 and the second cylinder 301 in front of the second piston large diameter portion (front) 311. The second piston rear chamber 303 is defined between the second piston 310 and the second cylinder 301 in the rear of the second piston large diameter portion (rear) 312. In the second piston front chamber 302 and the second piston rear chamber 303, a second piston front chamber port 302*a* and a second piston rear chamber port 303*a* are opened, respectively.

The second piston front chamber port 302*a* is connected to the high pressure circuit 101. This configuration causes pressure in the second piston front chamber 302 to be constantly high. The second piston rear chamber port 303*a* is connected to the discharge side of the second switching valve 320 via a second piston rear chamber passage 303*b*. The second piston rear chamber port 303*a* is selectively connected to the high pressure circuit 101 and the low pressure circuit 102 in an alternate manner by switching operation of the second switching valve 320. This configuration causes pressure in the second piston rear chamber 303 to be switched between high and low. In a moving range of the second piston middle groove 315, a second piston oil discharge port 304 is opened. The second piston oil discharge port 304 is connected to the low pressure circuit 102.

The second switching valve 320 is a fully hydraulically actuated pilot control valve. The second switching valve 320 includes a control port 320X and the hold port 320Y and is configured to perform switching operation with hold pressure constantly supplied to the hold port 320Y and control pressure charged to and discharged from the control port 320X. The control port 320X and the hold port 320Y are connected to the valve control means 204 and the decompression valve 109 via a second switching valve control passage 321 and a second switching valve hold passage 322, respectively.

The first switching valve 220 and the second switching valve 320 have the same specification except that configurations of switching ports thereof are set to have opposite phases to each other. As described afore, the first switching valve 220 and the second switching valve 320 have the control ports 220X and 320X connected to the valve control means 204, respectively, and, similarly, have the hold ports 220Y and 320Y connected to the decompression valve 109, respectively.

To the second cylinder 301, a striking chamber (front) 305 is formed in front of the second piston front chamber 302 and, therewith, a striking chamber (rear) 306 is formed in the rear of the second piston rear chamber 303. The striking chamber (front) 305 and the striking chamber (rear) 306 are in communication with each other via the second piston bore 317 and the second piston bore large diameter portion 317*a*.

Into the second piston bore 317, the first striking portion 107 of the transfer member 105 described above is inserted without contact from the front and, therewith, the first piston striking portion 216 is inserted without contact from the rear. The first piston striking surface 216*a* is arranged in such a way as to strike the first striking surface 107*a* of the transfer member 105 at a middle of the second piston bore 317. The second piston striking surface 316*a* is arranged in such a way as to strike the second striking surface 108*a* of the transfer member 105 in the striking chamber (front) 305.

Outer diameter of the first piston striking portion 216 and outer diameter of the first striking portion 107 of the transfer member are set at substantially the same diameter. Outer diameter of the second piston striking portion 316 and outer diameter of the second striking portion 108 of the transfer member are set at substantially the same diameter. Inner diameter of the second piston bore large diameter portion 317*a* is set larger than outer diameter of the first piston medium diameter portion 213.

A diameter difference between the second piston large diameter portion (front) 311 and the second piston medium diameter portion 313 is set smaller than a diameter difference between the second piston large diameter portion (rear) 312 and the second piston small diameter portion 314. Therefore, pressure receiving area of the second piston in the second piston front chamber 302 is smaller than pressure receiving area of the second piston in the second piston rear chamber 303. For this reason, when both the second piston front chamber 302 and the second piston rear chamber 303 are connected to the high pressure circuit 101, a pressure receiving area difference causes the second piston 310 to advance.

It is important to set the first switching valve 220 in the first striking mechanism 200 to be arranged in such a way that the first piston rear chamber passage 203*b* has a short length and does not have a complicated path (that is, to be arranged in such a way as to decrease pressure loss). This arrangement requirement also applies to an arrangement of the second switching valve 320 in the second striking mechanism 300, and, in the present embodiment, the first switching valve 220 and the second switching valve 320 are set in an ideal arrangement.

Further, it is important to arrange the first high pressure accumulator 230 and the first low pressure accumulator 231 in the first striking mechanism 200 in a vicinity of the first switching valve 220 where pulsation of pressurized oil is largest. This arrangement requirement also applies to an arrangement of the second high pressure accumulator 330 and the second low pressure accumulator 331 in the second striking mechanism 300, and, in the present embodiment, the first high pressure accumulator 230, the first low pressure accumulator 231, the second high pressure accumulator 330, and the second low pressure accumulator 331 are respectively set in an ideal arrangement.

In the two-piston hydraulic striking device 100 of the present embodiment, cycle times of the first striking mechanism 200 and the second striking mechanism 300 described above are set at the same cycle time. Hereinafter, a condition for setting the cycle times of the first striking mechanism 200 and the second striking mechanism 300 at the same cycle time will be described. The first striking mechanism 200, which includes the valve control means 204, serves as a base.

When it is assumed that an advance time of the first piston 210 (a time required for the first piston 210 to move from a back dead point to a striking position), a retraction acceleration time of the first piston (a time during which the pressure in the first piston rear chamber 203 is low), and a retraction deceleration time of the first piston (a time from a point of time when the pressure in the first piston rear chamber 203 becomes high to a point of time when the first piston reaches the back dead point) are denoted by t1a, t1b, and t1c, respectively, a cycle time T1 of the first striking mechanism 200 is expressed by the formula 1 below:

$$T1=t1a+t1b+t1c \quad \text{(Formula 1).}$$

A pressure receiving area ratio between the front and rear of the first piston 210, that is, diameters of the first piston medium diameter portion 213 and the first piston small diameter portion 214, are set in such a way that a relationship among the advance time, the retraction acceleration time, and the retraction deceleration time of the first piston 210 satisfies the formula 2 below:

$$[t1a+t1c]=t1b \quad \text{(Formula 2).}$$

Similarly, when it is assumed that an advance time of the second piston 310 (a time required for the second piston 310 to move from a back dead point to a striking position), a retraction acceleration time of the second piston (a time during which the pressure in the second piston rear chamber 303 is low), and a retraction deceleration time of the second piston (a time from a point of time when the pressure in the second piston rear chamber 303 becomes high to a point of time when the second piston reaches the back dead point) are denoted by t2a, t2b, and t2c, respectively, a cycle time T2 of the second striking mechanism 300 is expressed by the formula 3 below:

$$T2=t2a+t2b+t2c \quad \text{(Formula 3).}$$

A pressure receiving area ratio between the front and rear of the second piston 310, that is, diameters of the second piston medium diameter portion 313 and the second piston small diameter portion 314, are set in such a way that a relationship among the advance time, the retraction acceleration time, and the retraction deceleration time of the second piston 310 satisfies the formula 4 below:

$$[t2a+t2c]=t2b \quad \text{(Formula 4).}$$

When the pressure receiving area ratio between the front and rear of the first piston 210 and the pressure receiving area ratio between the front and rear of the second piston 310 are set to be the same, the formula 5 below holds:

$$[t1a+t1c]=t1b=[t2a+t2c]=t2b \quad \text{(Formula 5).}$$

From the formulae 1 to 5, the formula 6 below finally holds. Therefore, the cycle times of the two striking mechanisms become the same.

$$T1=T2 \quad \text{(Formula 6)}$$

According to the first embodiment, since the first striking mechanism 200 and the second striking mechanism 300 operate in an "alternate strike mode" in which the first striking mechanism 200 and the second striking mechanism 300 alternately strike the transfer member 105 at equal temporal intervals, the number of strikes doubles and the sum of striking energy is increased, which enables high output power to be achieved. Since, in the respective striking mechanisms, strike reaction forces on the respective striking mechanisms offset each other, vibration can be reduced.

Masses of the first piston 210 and the second piston 310 will now be considered.

In general, specification values of a hydraulic striking device are required to be set in such a way that striking energy per strike is less than a fatigue limit of a transfer member. When a hydraulic striking device that is set as described above is used, even an infinite number of strikes do not cause fatigue failure to occur in theory.

While performing alternate strikes when two pistons have a difference in masses thereof causes strikes with large striking energy and small striking energy to continue alternately, specification values of the hydraulic striking device are required to be set using the piston with larger striking energy (that is, the piston with a larger mass) as a base. Since, when attention is focused on the piston with a smaller mass, such a requirement causes margins against the fatigue limit to be incorporated into specification values relating to the piston, the hydraulic striking device, as a whole, becomes unable to deliver intended performance sufficiently.

While, as described above, strike reaction forces offset each other in the alternate strikes performed by the two pistons, a difference in the masses between the two pistons causes a difference in strike reaction forces as well, as a result of which offset effect is reduced. Therefore, in the two-piston hydraulic striking device of the present invention, it is preferable to set the masses of the two pistons at the same mass. In the two-piston hydraulic striking device 100 of the present embodiment, the masses of the two pistons are set at the same mass. This configuration enables an optimal design in consideration of a fatigue limit to be achieved and, in particular, offset effect between strike reaction forces in the case of operation in the alternate strike mode to be had to the maximum extent possible.

However, in the case of a so-called tandem type two-piston hydraulic striking device as in the present embodiment, it is supposed that differences between the first piston and the second piston, such as a large difference in shapes thereof and a difference in a positional relationship between arrangements on the front and rear side, cause a difference to be produced in repulsive forces received from the transfer member and the difference in repulsive forces causes an adverse effect on the alternate strikes. In this case, performing adjustment by differentiating the masses between the two pistons is a possible measure against the problem.

Next, respective variations (first to tenth variations) of the first embodiment described above will be described in order below. The same signs are assigned to the same constituent components as those in the first embodiment described above, and, therewith, a description thereof will be omitted.

First Variation

Figure 2:
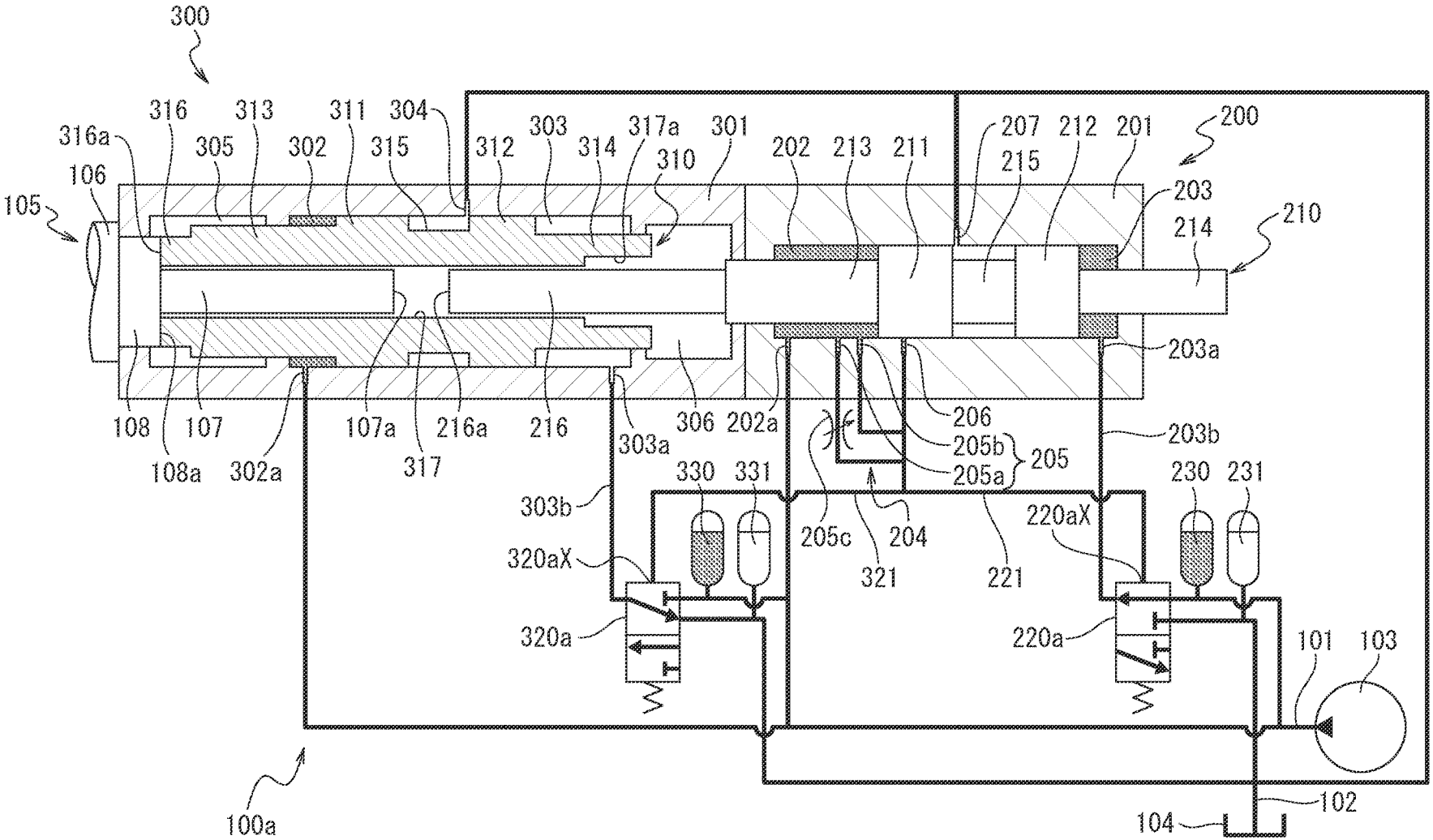
FIG. 2 is a longitudinal cross-sectional view of a first variation of the first embodiment.

FIG. 2 illustrates a two-piston hydraulic striking device 100*a* of a first variation of the first embodiment.

As illustrated in FIG. 2, a difference from the two-piston hydraulic striking device 100 of the first embodiment is that, in place of the first switching valve 220 and the second switching valve 320 in the first embodiment, a first switching valve 220*a* and a second switching valve 320*a* are used. Each of the first switching valve 220*a* and the second switching valve 320*a* is a spring return type control valve that includes, in substitution for the hold port in the first embodiment, a spring.

Control ports 220*a*X and 320*a*X, as with the first embodiment, are connected to a valve control means 204. The first switching valve 220*a* and the second switching valve 320*a* can perform switching operation that is similar to that in the first embodiment by means of control pressure supplied from the valve control means 204. According to the first variation, a decompression valve 109 and hold passages 222 and 322 can be omitted as illustrated in FIG. 2, as a result of which it becomes possible to simplify a device configuration.

Second Variation

Figure 3:
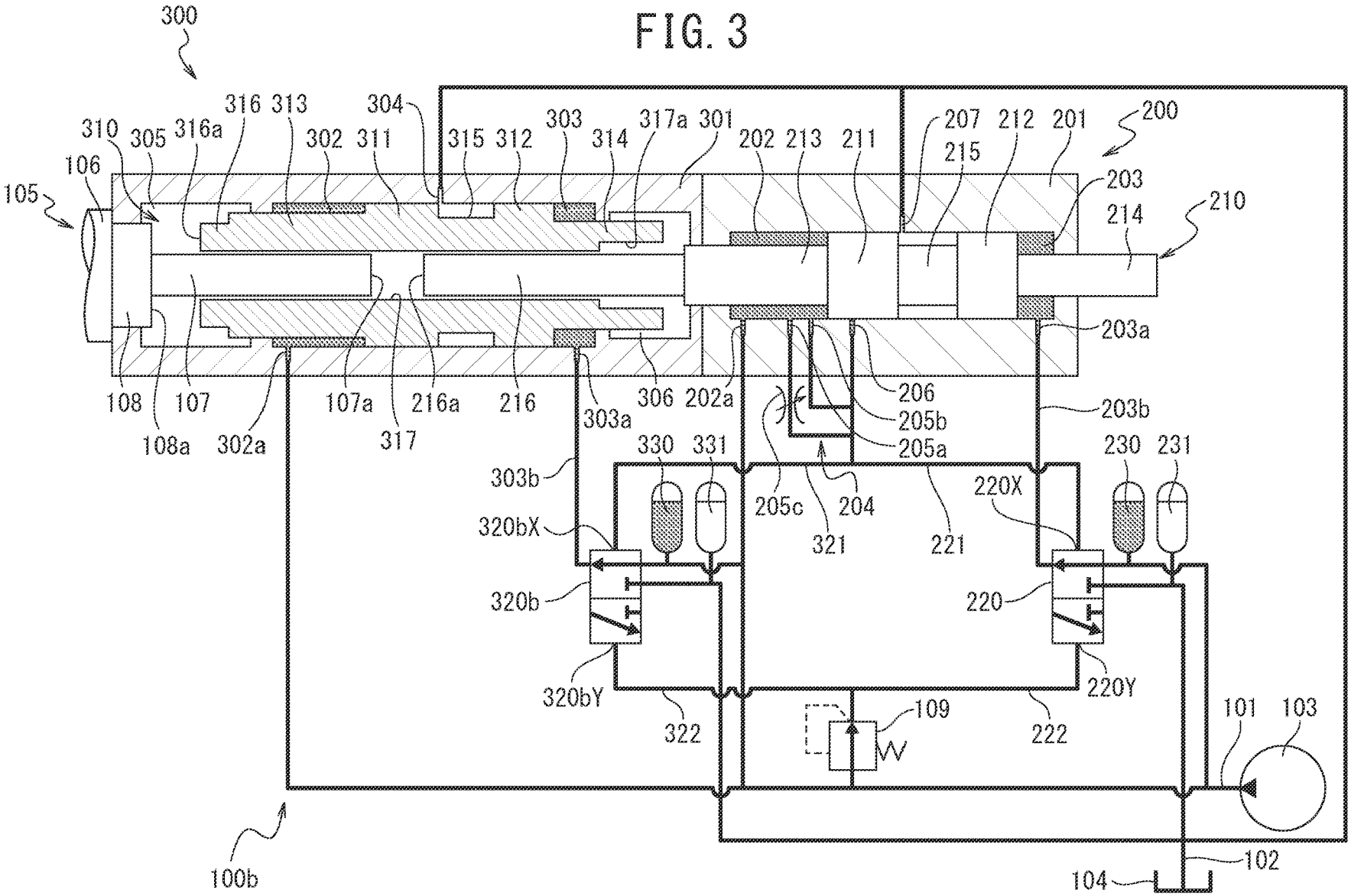
FIG. 3 is a longitudinal cross-sectional view of a second variation of the first embodiment.

FIG. 3 illustrates a two-piston hydraulic striking device 100*b* of a second variation of the first embodiment.

As illustrated in FIG. 3, a difference from the two-piston hydraulic striking device 100 of the first embodiment is that switching ports of a second switching valve 320*b* are set to have the same phase as that of switching ports of a first switching valve 220. Control ports 320*b*X and 320*b*Y are connected to a valve control means 204 and a decompression valve 109, respectively, and switching operation itself is not different from that in the first embodiment.

According to the second variation, the two-piston hydraulic striking device 100*b* operates in a "simultaneous strike mode" in which a first striking mechanism 200 and a second striking mechanism 300 strike a transfer member 105 at the same time. Since operation in the simultaneous strike mode can increase striking energy per strike to twice that in the alternate strike mode, the simultaneous strike mode is effective in a case where a crushing target is hard rock.

Third Variation

Figure 4:
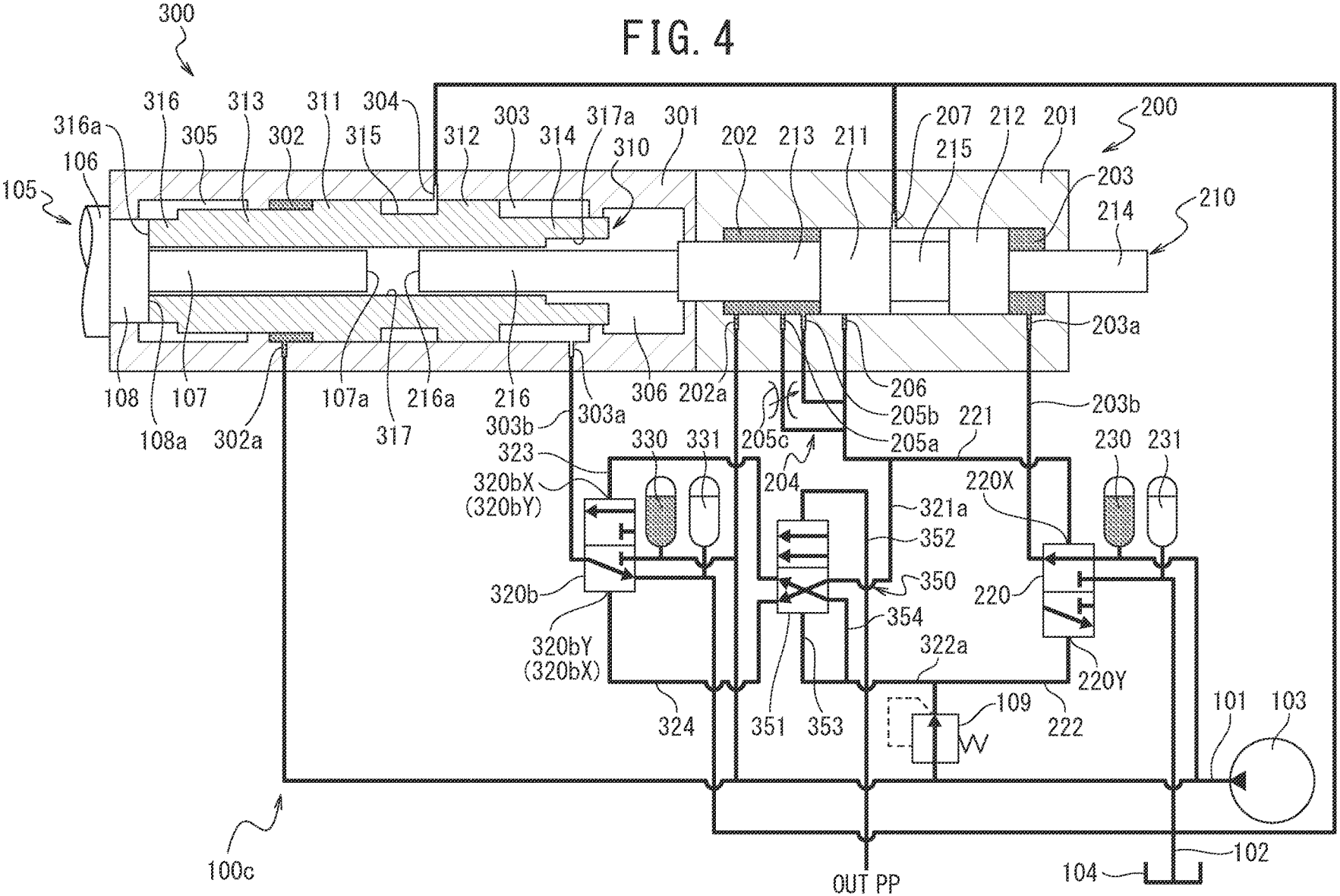
FIG. 4 is a longitudinal cross-sectional view of a third variation of the first embodiment.

FIG. 4 illustrates a two-piston hydraulic striking device 100*c* of a third variation. Note that the two-piston hydraulic striking device 100*c* of the third variation has a configuration in which a "mode selection means" is added to the configuration of the two-piston hydraulic striking device 100*b* of the second variation described above.

That is, as illustrated in FIG. 4, a difference from the two-piston hydraulic striking device 100*b* of the second variation is that a second striking mechanism operation mode selection means 350 is disposed between a control port 320*b*X of a second switching valve 320*b* and a valve control means 204 and between a hold port 320*b*Y and a decompression valve 109.

The second striking mechanism operation mode selection means 350 is configured including a control pressure switching valve 351, a control passage 352, a hold passage 353, and a second switching valve hold pressure supply passage 354. The input side of the control pressure switching valve 351 is connected to the valve control means 204 via a control passage 321*a* and therewith connected to the decompression valve 109 via the second switching valve hold pressure supply passage 354 and a hold passage 322*a*. The discharge side of the control pressure switching valve 351 is connected to the control port 320*b*X via a control passage 323 and therewith connected to the hold port 320*b*Y via a hold passage 324. The control passage 352 is connected to an external pilot control pressure source OUTPP.

When the control pressure switching valve 351 is in a state illustrated in FIG. 4, that is, a state in which no control pressure from the pilot control pressure source OUTPP is supplied thereto, the control pressure switching valve 351 is set to a switching port at the lower position in FIG. 4. This setting causes the control port 320*b*X of the second switching valve 320*b* to be connected to the second switching valve hold pressure supply passage 354 and to be changed to the hold port 320*b*Y. The setting also causes the hold port 320*b*Y to be connected to the control passage 321*a* and to be changed to the control port 320*b*X. That is, the second switching valve 320*b* has arrangements of the control port and the hold port switched and thereby has an opposite phase to that of a first switching valve 220, as a result of which the two-piston hydraulic striking device 100*c* operates in the alternate strike mode.

However, when the control pressure from the pilot control pressure source OUTPP is supplied, the control pressure switching valve 351 is switched to a switching port at the upper position in FIG. 4. This switch causes the control port 320*b*X and the hold port 320*b*Y of the second switching valve 320*b*, the arrangements of which have been switched, to return to the original states and the second switching valve 320*b* to come to have the same phase as that of the first switching valve 220, as a result of which the two-piston hydraulic striking device 100*c* operates in the simultaneous strike mode.

As described above, in the third variation, the alternate strike mode and the simultaneous strike mode can be selected by making the second striking mechanism operation mode selection means 350 switch the phase of switching ports of the second switching valve 320*b* between the opposite phase and the same phase with respect to the first switching valve 220. Accordingly, the third variation enables drilling work to be performed selecting an optimum strike mode suitable for a crushing target, such as selecting the alternate strike mode in a case where the crushing target is soft rock and selecting the simultaneous strike mode in a case where the crushing target is hard rock.

Fourth Variation

Figure 5:
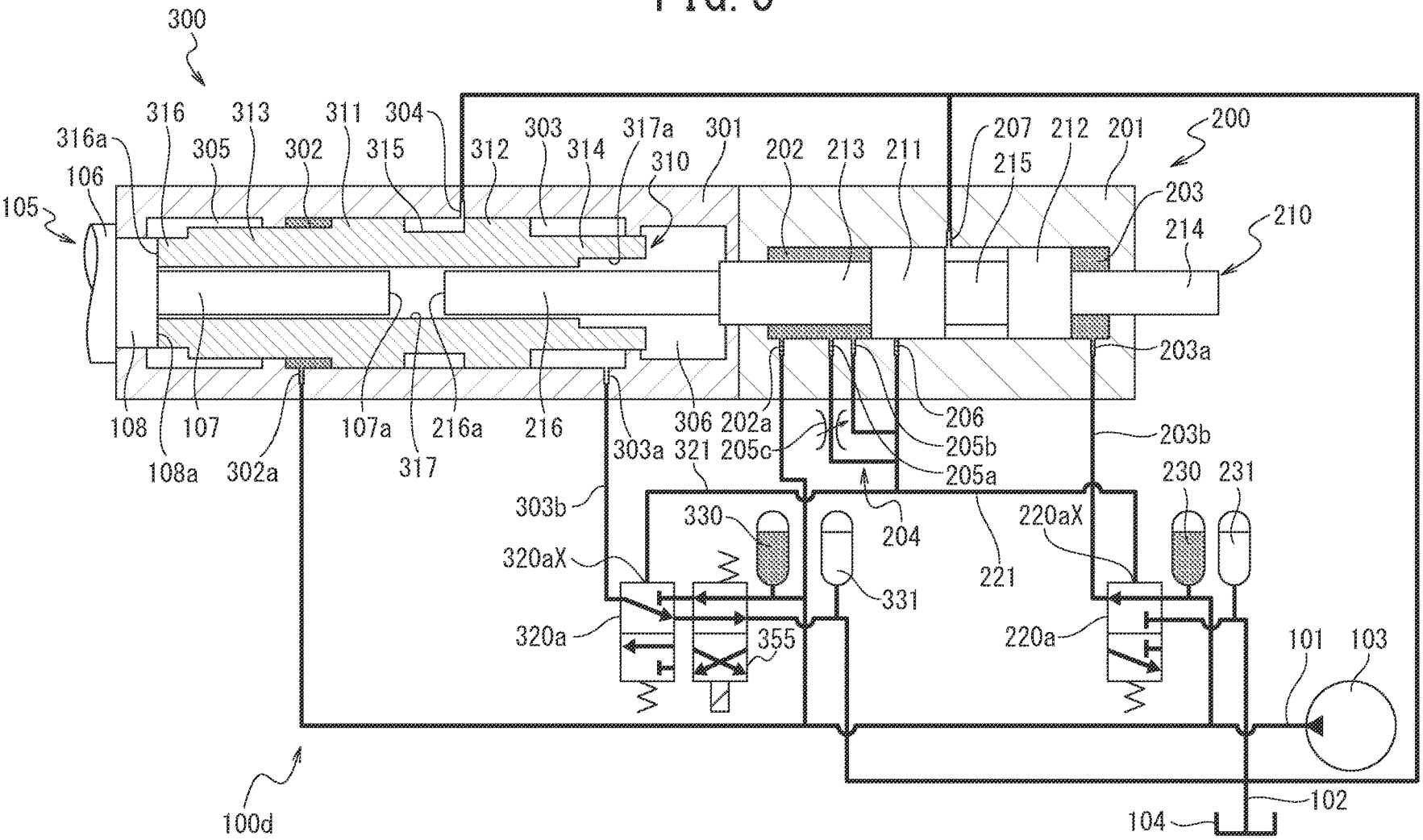
FIG. 5 is a longitudinal cross-sectional view of a fourth variation of the first embodiment.

FIG. 5 illustrates a two-piston hydraulic striking device 100*d* of a fourth variation. Note that the two-piston hydraulic striking device 100*d* of the fourth variation has a configuration in which a "mode selection means" is added to the configuration of the two-piston hydraulic striking device 100*a* of the first variation described above. That is, as illustrated in FIG. 5, a difference from the two-piston hydraulic striking device 100*a* of the first variation is that a circuit switching valve 355 is disposed on the input side of a second switching valve 320*a* as a second striking mechanism operation mode selection means.

When the circuit switching valve 355 is in a state illustrated in FIG. 5, that is, a state in which no control signal is applied thereto, the circuit switching valve 355 is set to a switching port at the upper position in FIG. 5 and a circuit configuration of a high pressure circuit 101 and a low pressure circuit 102 that are connected to the input side of the second switching valve 320*a* are thereby maintained. Thus, switching ports of a second switching valve 320*a* have an opposite phase to that of a first switching valve 220*a*, as a result of which the two-piston hydraulic striking device 100*d* operates in the alternate strike mode.

However, when the control signal is applied to the circuit switching valve 355, the circuit switching valve 355 is switched to a switching port at the lower position in FIG. 5. This switch causes the circuit configuration of the high pressure circuit 101 and the low pressure circuit 102, which are connected to the input side of the second switching valve 320*a*, to switch to an opposite configuration. Thus, the switching ports of the second switching valve 320*b* come to have the same phase as that of the first switching valve 220*a*, as a result of which the two-piston hydraulic striking device 100*d* operates in the simultaneous strike mode.

As described above, in the fourth variation, the alternate strike mode and the simultaneous strike mode can be selected by making the circuit switching valve 355 switch the phase of the switching ports of the second switching valve 320*a* between the opposite phase and the same phase with respect to the first switching valve. Accordingly, the fourth variation enables drilling work to be performed selecting an optimum strike mode suitable for a crushing target, such as selecting the alternate strike mode in a case where the crushing target is soft rock and selecting the simultaneous strike mode in a case where the crushing target is hard rock.

The third variation and the fourth variation described above are variations that illustrate examples of the second striking mechanism operation mode selection means. In other words, in the third variation, the phase of the switching ports is switched by switching arrangements of the control port 320*b*X and the hold port 320*b*Y of the second switching valve 320*b*, and, in the fourth variation, the phase of the switching ports is switched by switching the circuit configuration of the high pressure circuit 101 and the low pressure circuit 102, which are connected to the second switching valve 320*a*, to an opposite configuration.

Comparison between both variations reveals that, in the third variation, although hydraulic components have a complicated configuration in the sense of including the decompression valve 109, the control pressure switching valve 351, and a lot of connection passages, pressure loss is low because only the second high pressure accumulator 330 and the second switching valve 320*a* are disposed in a path from the high pressure circuit 101 to the second piston rear chamber 303.

By contrast, in the fourth variation, although an increase in pressure loss cannot be avoided because the circuit switching valve 355 is added between the second high pressure accumulator 330 and the second switching valve 320*a* in a path from the high pressure circuit 101 to the second piston rear chamber 303, a component configuration is simplified because no hydraulic component other than the circuit switching valve 355 is required. Since the third variation and the fourth variation respectively have advantages and disadvantages as described above, the variations are expected to be appropriately selected depending on a use and a cost of drilling work.

Fifth Variation

Figure 6:
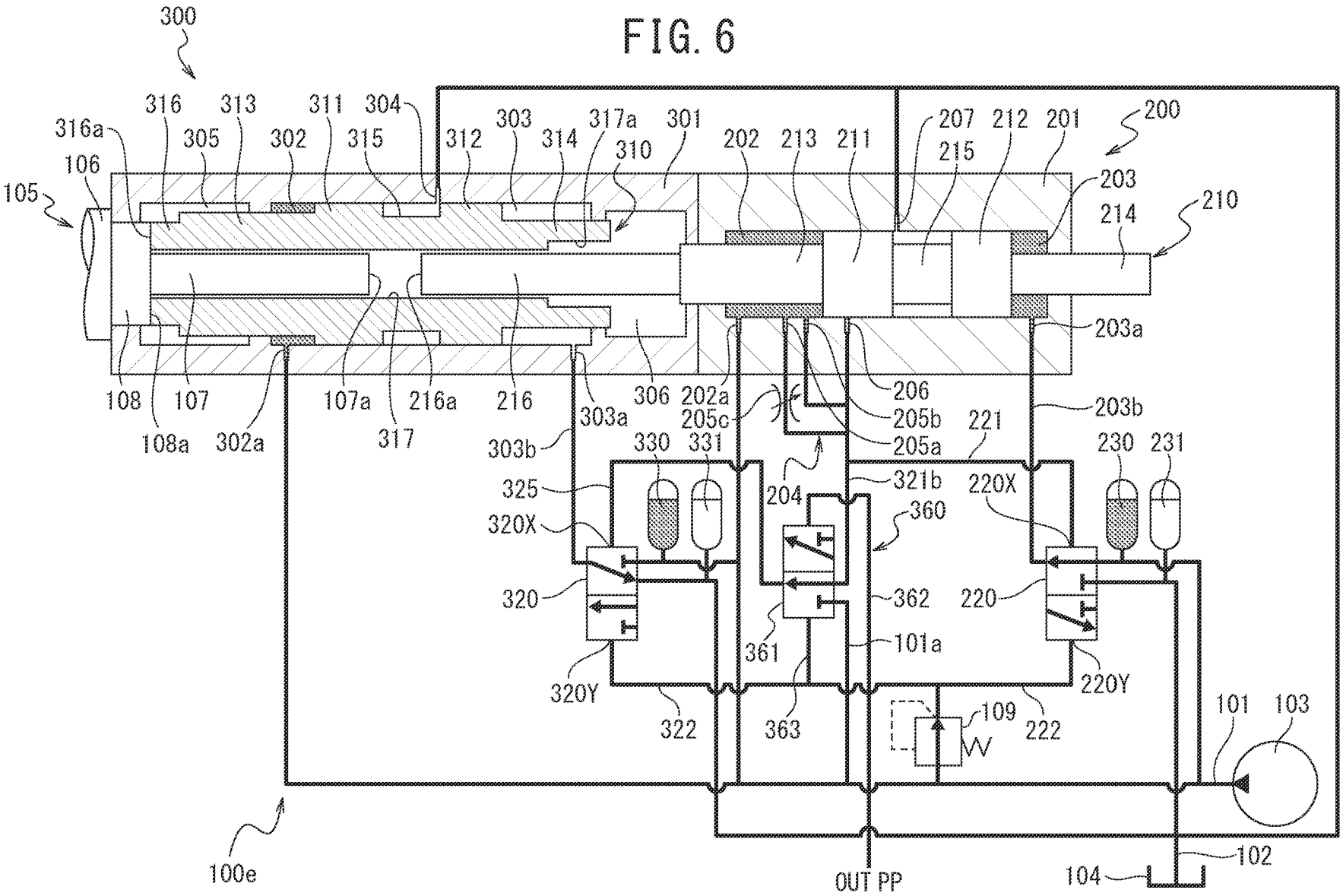
FIG. 6 is a longitudinal cross-sectional view of a fifth variation of the first embodiment.

FIG. 6 illustrates a two-piston hydraulic striking device 100*e* of a fifth variation. Note that the two-piston hydraulic striking device 100*e* of the fifth variation has a configuration in which a "stopping means" is added to the configuration of the two-piston hydraulic striking device 100 of the first embodiment described above. That is, as illustrated in FIG. 6, a difference from the two-piston hydraulic striking device 100 of the first embodiment is that a second striking mechanism stopping means 360 is disposed between a control port 320X of a second switching valve 320 and a valve control means 204 and between a hold port 320Y and a decompression valve 109.

The second striking mechanism stopping means 360 is configured including a selection valve 361, a control passage 362, and a hold passage 363. The input side of the selection valve 361 is connected to the valve control means 204 via a control passage 321*b* and therewith connected to a high pressure circuit 101 via a branch passage 101*a*. The discharge side of the selection valve 361 is connected to the control port 320X via a control passage 325. The control passage 362 is connected to an external pilot control pressure source OUTPP. The hold passage 363 is connected to the decompression valve 109.

When the selection valve 361 is in a state illustrated in FIG. 6, that is, a state in which no control pressure from the pilot control pressure source OUTPP is supplied thereto, the selection valve 361 is set to a switching port at the lower position in FIG. 6. This setting causes the control port 320X of the second switching valve 320 to be connected to the valve control means 204 by way of the control passage 321*b*. Since the second switching valve 320 therefore performs switching operation in accordance with control pressure supplied from the valve control means 204, the second striking mechanism operates in the alternate strike mode.

However, when the control pressure is supplied from the pilot control pressure source OUTPP, the selection valve 361 is switched to a switching port at the upper position in FIG. 6. This switch causes the control port 320X of the second switching valve 320 to be connected to the high pressure circuit 101 via the branch passage 101*a*. This connection causes the second switching valve 320 to be constantly held to a switching port at the upper position in FIG. 6. Since a second piston rear chamber 303 therefore is constantly connected to low pressure, a second piston 310 retracts to a back dead point and stops. Therefore, the two-piston hydraulic striking device 100*e* operates in a "single piston strike mode" in which only a first piston 210 strikes a transfer member 105. According to the fifth variation, making the single piston strike mode selectable enables so-called "light strikes" to be performed that halve the number of strikes compared with the alternate strike mode and halve striking energy compared with the simultaneous strike mode, as a result of which versatility of drilling work is increased.

Sixth Variation

Figure 7:
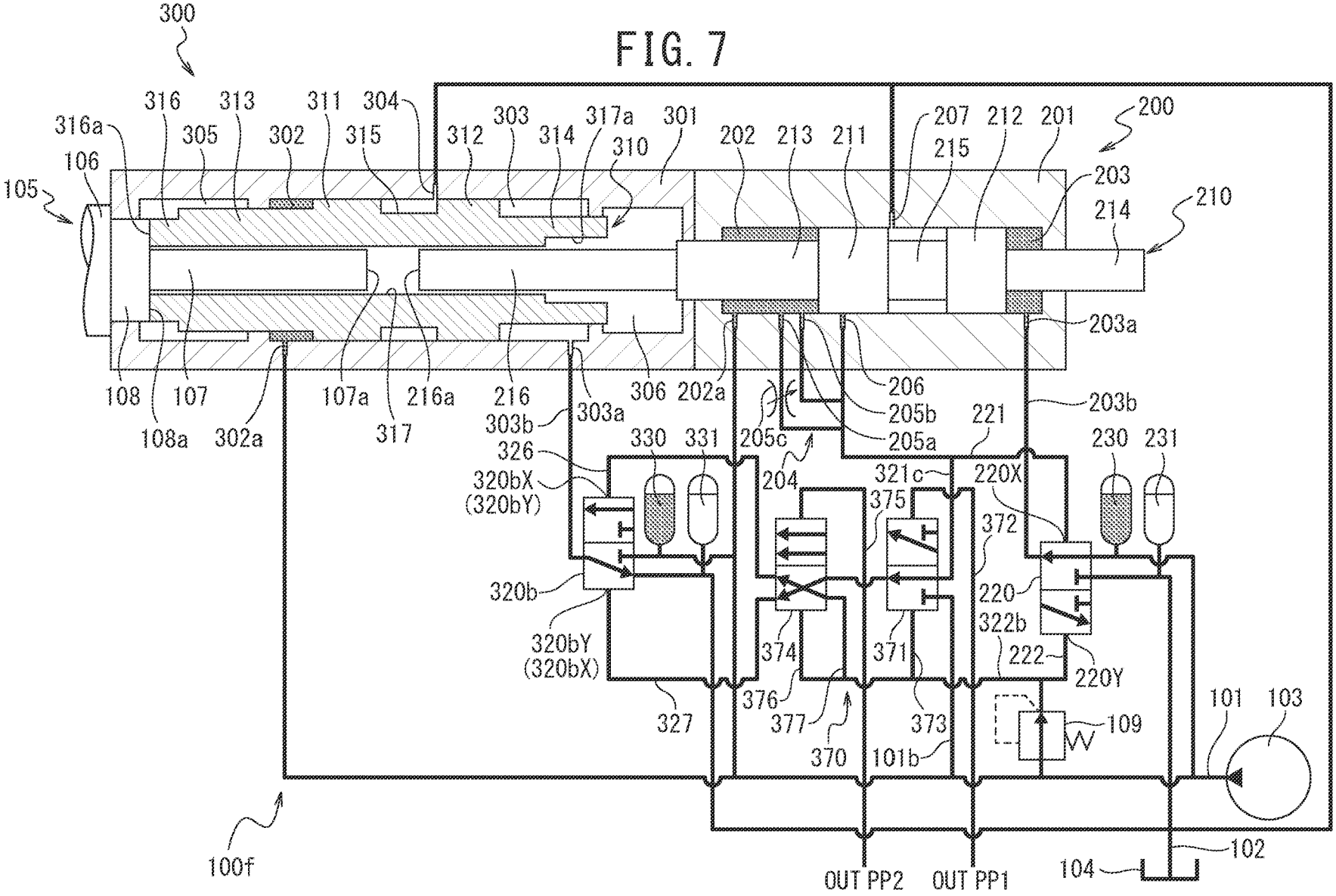
FIG. 7 is a longitudinal cross-sectional view of a sixth variation of the first embodiment.

FIG. 7 illustrates a two-piston hydraulic striking device 100*f* of a sixth variation. Note that the two-piston hydraulic striking device 100*f* of the sixth variation has a configuration that includes both a second striking mechanism operation mode selection means, which is a key component in the third variation, and a second striking mechanism stopping means, which is a key component in the fifth variation, at the same time.

That is, as illustrated in FIG. 7, a difference from the two-piston hydraulic striking device 100*c* of the third variation is that a second striking mechanism operation mode selection means 370 is disposed between a control port 320*b*X of a second switching valve 320*b* and a valve control means 204 and between a hold port 320*b*Y and a decompression valve 109.

The second striking mechanism operation mode selection means 370 is configured including a selection valve 371, a control passage 372, a hold passage 373, a control pressure switching valve 374, a control passage 375, a hold passage 376, and a second switching valve hold pressure supply passage 377. The input side of the selection valve 371 is connected to the valve control means 204 via a control passage 321*c* and therewith connected to a high pressure circuit 101 via a branch passage 101*b*. The discharge side of the selection valve 371 is connected to the input side of the control pressure switching valve 374. The control passage 372 is connected to an external pilot control pressure source OUTPP1.

The input side of the control pressure switching valve 374 is connected to the discharge side of the selection valve 371 as described above and is connected to the decompression valve 109 via the second switching valve hold pressure supply passage 377 and a hold passage 322*b*. The discharge side of the control pressure switching valve 374 is connected to the control port 320*b*X via a control passage 326 and is connected to the hold port 320*b*Y via a hold passage 327. The control passage 375 is connected to an external pilot control pressure source OUTPP2. The hold passage 376 is connected to the decompression valve 109.

When the selection valve 371 and the control pressure switching valve 374 are in a state illustrated in FIG. 7, that is, a state in which no control pressure from the pilot control pressure sources OUTPP1 and OUTPP2 is supplied thereto, the selection valve 371 and the control pressure switching valve 374 are respectively set to switching ports at the lower positions in FIG. 7. This setting causes the control port 320*b*X of the second switching valve 320*b* to be connected to the second switching valve hold pressure supply passage 377 and to be changed to the hold port 320*b*Y. The setting also causes the hold port 320*b*Y to be connected to the control passage 321*c* and to be changed to the control port 320*b*X. That is, the second switching valve 320*b* has arrangements of the control port and the hold port switched and thereby has an opposite phase to that of the first switching valve 220, as a result of which the two-piston hydraulic striking device 100*f* operates in the alternate strike mode.

Next, when only control pressure from the pilot control pressure source OUTPP2 is supplied, the control pressure switching valve 374 is switched to a switching port at the upper position in FIG. 7. This switch causes the control port 320*b*X and the hold port 320*b*Y of the second switching valve 320*b*, the arrangements of which have been switched, to return to the original states. Therefore, the second switching valve 320*b* comes to have the same phase as that of the first switching valve 220, as a result of which the two-piston hydraulic striking device 100*f* operates in the simultaneous strike mode.

Next, when only control pressure from the pilot control pressure source OUTPP1 is supplied, the control pressure switching valve 374 is kept to the switching port at the lower position in FIG. 7 and the selection valve 371 is switched to a switching port at the upper position in FIG. 7. These actions cause the hold port 320*b*Y of the second switching valve 320*b* to be connected to the high pressure circuit 101 via the branch passage 101*b*. Therefore, the second switching valve 320*b* is constantly held to a switching port at the lower position in FIG. 7, and a second piston rear chamber 303 is thereby constantly connected to low pressure. Since this connection causes a second piston 310 to retract to a back dead point and stop, the two-piston hydraulic striking device 100*f* operates in the single piston strike mode in which only a first piston 210 strikes a transfer member 105.

Last, when both the control pressure from the pilot control pressure source OUTPP1 and the control pressure from the pilot control pressure source OUTPP2 are supplied, both the selection valve 371 and the control pressure switching valve 374 are switched to the switching ports at the upper positions in FIG. 7. This switch causes the control port 320*b*X of the second switching valve 320*b* to be connected to the high pressure circuit 101 via the branch passage 101*b*. Therefore, the second switching valve 320*b* is constantly held to a switching port at the upper position in FIG. 7, and the second piston rear chamber 303 is thereby constantly connected to high pressure, as a result of which the second piston 310 advances to a front dead point and stops.

Since, on this occasion, the second piston 310 pushes the transfer member 105 forward and stops, the two-piston hydraulic striking device 100*f* operates in a single piston strike mode at an advanced position in which the first piston 210 strikes the transfer member 105 at a position advanced beyond an impact point. While strikes in the single piston strike mode are "light strikes" the striking energy of which is smaller than that in the alternate strike mode and the simultaneous strike mode, it can be said that strikes in the single piston strike mode at an advanced position are "small strikes" the striking energy of which is further reduced.

As described above, in the sixth variation, the second striking mechanism operation mode selection means 370 allows selection from the "alternate strike mode", the "simultaneous strike mode", and the "single piston strike mode" and also allows selection from a case of performing the "light strikes" with a stop position of the second piston 310 when operating in the "single piston strike mode" set at the back dead point and a case of performing the "small strikes" with the stop position set at the front dead point, as a result of which versatility of drilling work is increased.

Seventh Variation

Figure 8:
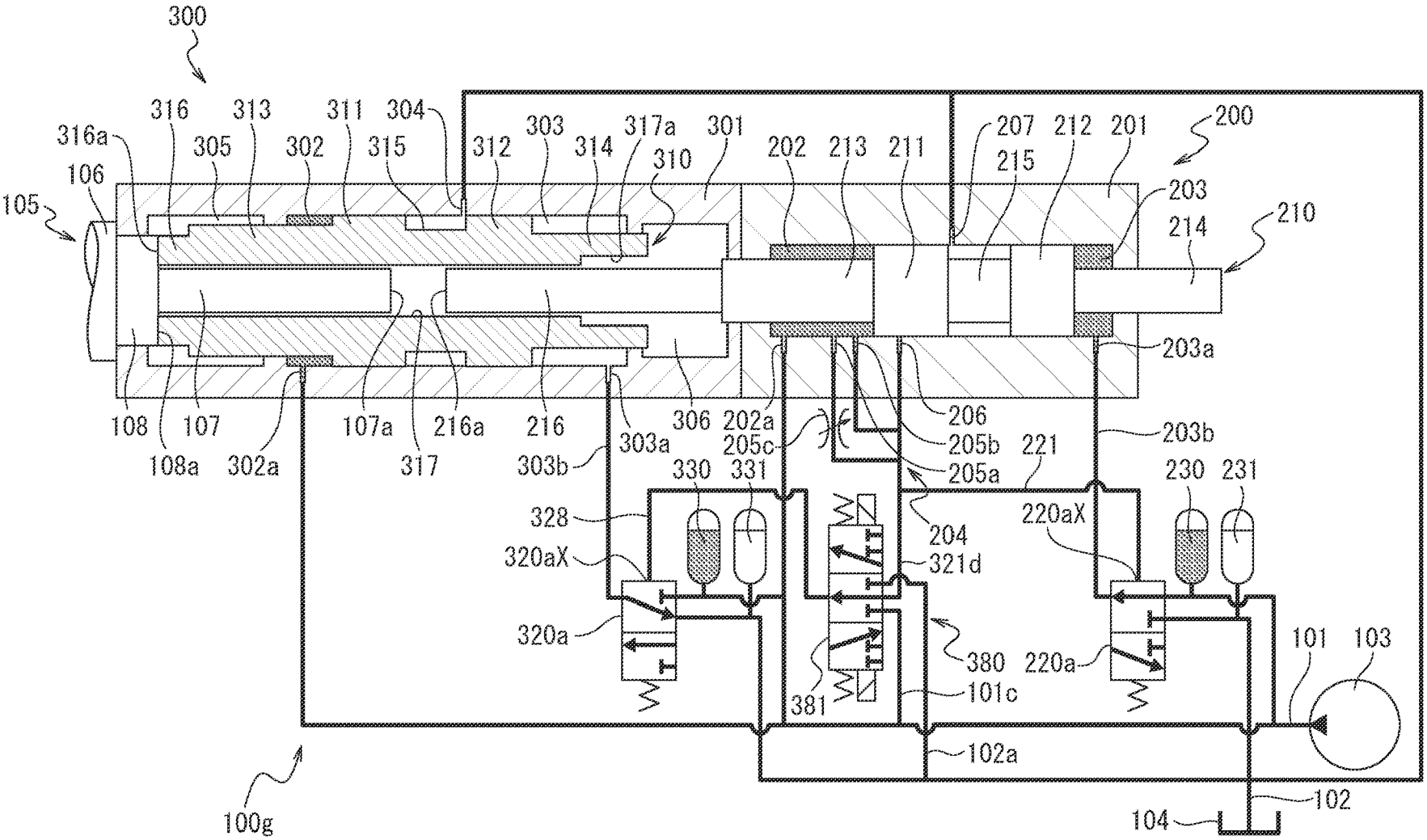
FIG. 8 is a longitudinal cross-sectional view of a seventh variation of the first embodiment.

FIG. 8 illustrates a two-piston hydraulic striking device 100*g* of a seventh variation. Note that the two-piston hydraulic striking device 100*g* of the seventh variation has a configuration in which a "stopping means" is added to the configuration of the two-piston hydraulic striking device 100*a* of the first variation described above. That is, as illustrated in FIG. 8, a difference from the two-piston hydraulic striking device 100*a* of the first variation is that a second striking mechanism stopping means 380 is disposed between a control port 320*a*X of a second switching valve 320*a* and a valve control means 204, between the control port 320*a*X and a high pressure circuit 101, and between the control port 320*a*X and a low pressure circuit 102.

The second striking mechanism stopping means 380 is configured including a selection valve 381, and the input side of the selection valve 381 is connected to the valve control means 204 via a control passage 321*d* and therewith connected to the high pressure circuit 101 via a branch passage 101*c*, and further is connected to the low pressure circuit 102 via a branch passage 102*a*. The discharge side of the selection valve 381 is connected to the control port 320*a*X via a control passage 328.

When the selection valve 381 is in a state illustrated in FIG. 8, that is, a state in which no voltage is applied thereto, the control port 320*a*X is connected to the valve control means 204. Since the second switching valve 320*a* therefore performs switching operation in accordance with control pressure supplied from the valve control means 204, the second striking mechanism operates in the alternate strike mode.

However, when, by applying voltage to a solenoid on the upper side of the selection valve 381, the selection valve 381 is switched to a switching port at the upper position in FIG. 8, the control port 320*a*X is connected to the high pressure circuit 101 via the branch passage 101*c*. Thus, the second switching valve 320*a* is constantly held to a switching port at the upper position in FIG. 8, and, thereby, the second piston rear chamber 303 is constantly connected to low pressure. Since this connection causes a second piston 310 to retract to a back dead point and stop, the two-piston hydraulic striking device 100*g* operates in the single piston strike mode in which only a first piston 210 strikes a transfer member 105.

However, when, by applying voltage to a solenoid on the lower side of the selection valve 381, the selection valve 381 is switched to a switching port at the lower position in FIG. 8, the control port 320*a*X is connected to the low pressure circuit 102 via the branch passage 102*a*. Thus, the second switching valve 320*a* is held to a switching port at the lower position in FIG. 8, and, thereby, the second piston rear chamber 303 is constantly connected to high pressure. This connection causes the second piston 310 to advance to a front dead point and stop. Since, on this occasion, the second piston 310 pushes the transfer member 105 forward and stops, the two-piston hydraulic striking device 100*g* operates in a single piston strike mode at an advanced position in which the first piston 210 strikes the transfer member 105 at a position advanced beyond an impact point.

As described above, in the seventh variation, the second striking mechanism stopping means 380 allows selection from the "alternate strike mode" and the "single piston strike mode" and also allows selection from a case of performing the "light strikes" with a stop position of the second piston 310 when operating in the "single piston strike mode" set at the back dead point and a case of performing the "small strikes" with the stop position set at the front dead point, as a result of which versatility of drilling work is increased.

Eighth Variation

Figure 9:
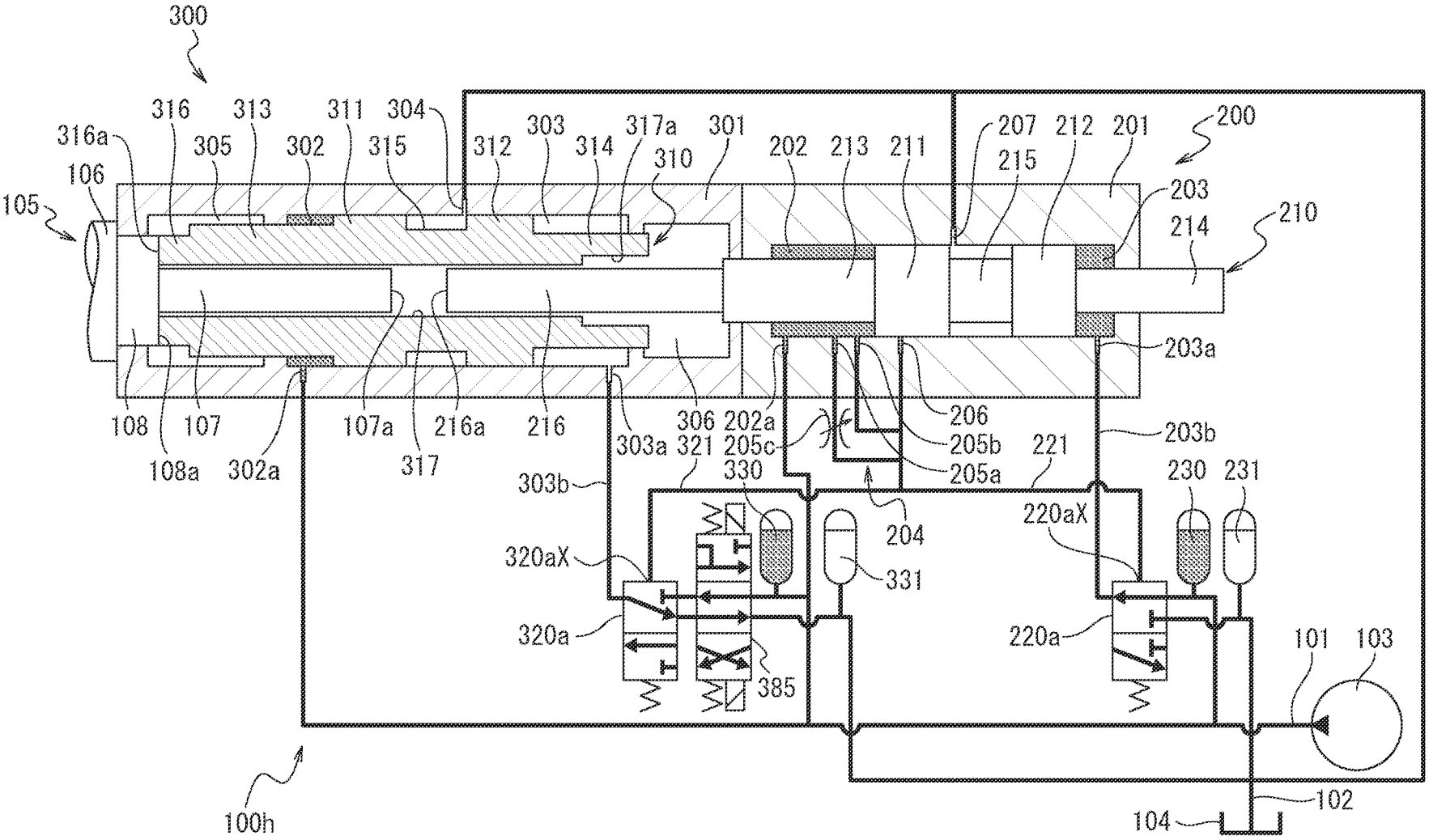
FIG. 9 is a longitudinal cross-sectional view of an eighth variation of the first embodiment.

FIG. 9 illustrates a two-piston hydraulic striking device 100*h* of an eighth variation. Note that the two-piston hydraulic striking device 100*h* of the eighth variation has a configuration in which a "mode selection means" is added to the configuration of the two-piston hydraulic striking device 100*a* of the first variation described above. That is, as illustrated in FIG. 9, a difference from the two-piston hydraulic striking device 100*a* of the first variation is that a three-position switching valve 385 is disposed on the input side of a second switching valve 320*a* as a second striking mechanism operation mode selection means. The three-position switching valve 385 is a circuit switching valve that is configured by adding a switching port to the circuit switching valve 355 of the fourth variation described above and disposing a pair of an electromagnetic solenoid and a spring to each side of the circuit switching valve 355.

When the three-position switching valve 385 is in a state illustrated in FIG. 9, that is, a state in which no control signal is applied thereto, the three-position switching valve 385 is set to a switching port at the middle position in FIG. 9. Thus, a circuit configuration of a high pressure circuit 101 and a low pressure circuit 102 that are connected to the input side of a second switching valve 320*a* is maintained and switching ports of the second switching valve 320*a* have an opposite phase to that of a first switching valve 220*a*, as a result of which the two-piston hydraulic striking device 100*h* operates in the alternate strike mode.

However, when a control signal is applied to the solenoid on the lower side of the three-position switching valve 385, the three-position switching valve 385 is switched to a switching port at the lower position in FIG. 9. This switch causes the circuit configuration of the high pressure circuit 101 and the low pressure circuit 102, which are connected to the input side of the second switching valve 320*a*, to switch to an opposite configuration. Thus, the switching ports of the second switching valve 320*a* have the same phase as that of the first switching valve 220*a*, as a result of which the two-piston hydraulic striking device 100*h* operates in the simultaneous strike mode.

On the other hand, when a control signal is applied to the solenoid on the upper side of the three-position switching valve 385, the three-position switching valve 385 is switched to a switching port at the upper position in FIG. 9. This switch causes all the input side of the second switching valve 320*a* to be connected to the low pressure circuit 102. Therefore, even when the second switching valve 320*a* is switched by control pressure from a valve control means 204, a second piston rear chamber 303 is constantly connected to low pressure. Since this connection causes a second piston 310 to retract to a back dead point and stop, the two-piston hydraulic striking device 100*h* operates in the single piston strike mode in which only a first piston 210 strikes a transfer member 105.

As described above, in the eighth variation, it is possible, by use of the three-position switching valve 385, to switch the phase of the switching ports of the second switching valve 320*a* between the opposite phase and the same phase with respect to the first switching valve and, in addition, constantly connect the second piston rear chamber to low pressure regardless of a switching position of the second switching valve 320*a*. Accordingly, the eighth variation allows selection from the alternate strike mode, the simultaneous strike mode, and the single piston strike mode and thereby enables drilling work to be performed using an optimum strike mode suitable for a crushing target and work details.

Ninth Variation

Figure 10:
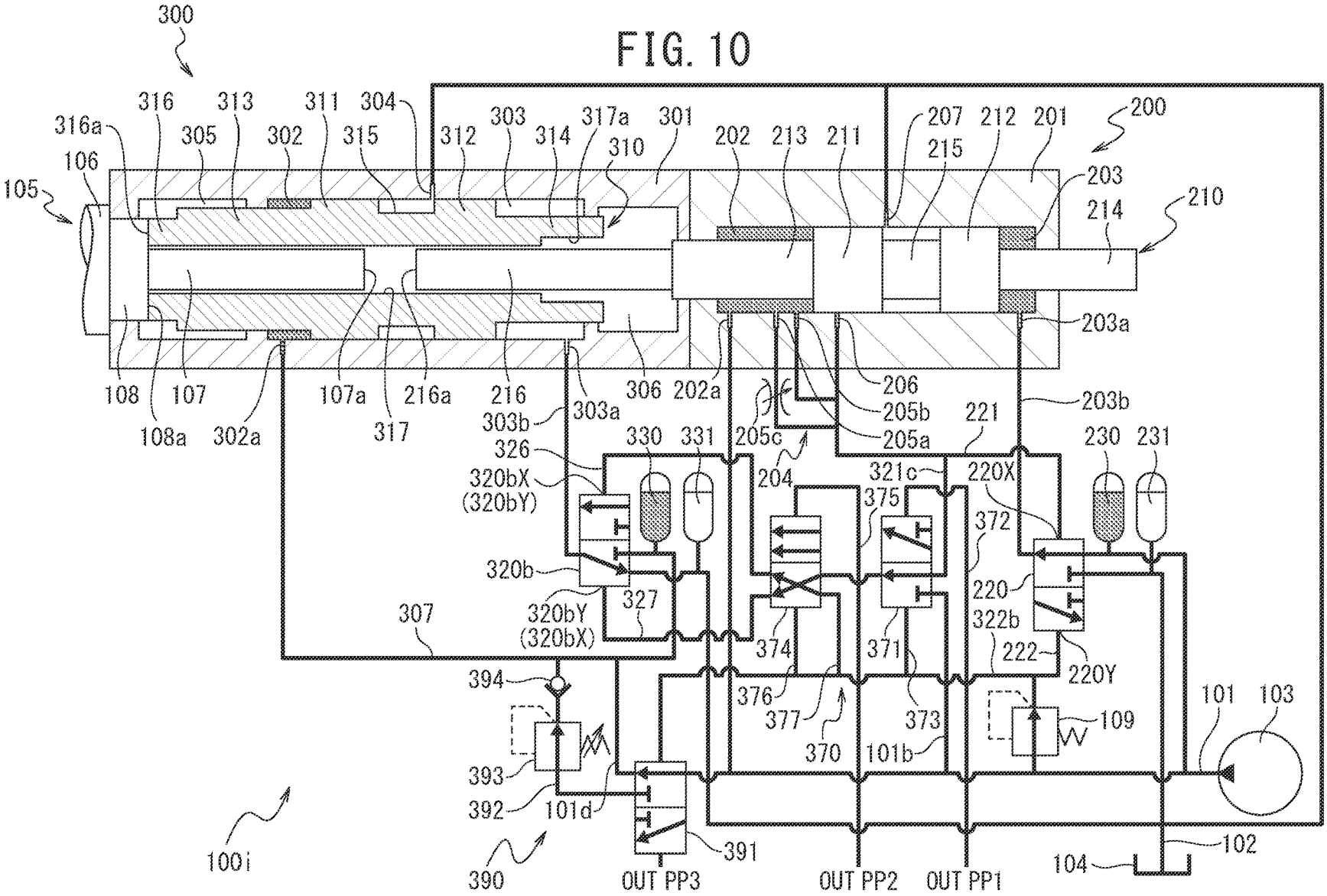
FIG. 10 is a longitudinal cross-sectional view of a ninth variation of the first embodiment.

FIG. 10 illustrates a two-piston hydraulic striking device 100*i* of a ninth variation. Note that the two-piston hydraulic striking device 100*i* of the ninth variation has a configuration in which a "thrust adjustment means" is added to the configuration of the two-piston hydraulic striking device 100*f* of the sixth variation described above. That is, as illustrated in FIG. 10, a difference from the two-piston hydraulic striking device 100*f* of the sixth variation is that a portion of a high pressure circuit 101 on the side where a second striking mechanism 300 is located is changed to a second striking mechanism operating pressure passage 307 and a second striking mechanism stopping thrust adjustment means 390 is disposed between the second striking mechanism operating pressure passage 307 and the high pressure circuit 101. The second striking mechanism stopping thrust adjustment means 390 is configured including a selection valve 391, a reduced pressure passage 392, a decompression valve 393, a check valve 394, and a branch passage 101*d*.

While, as described above, in the sixth variation, the second striking mechanism operation mode selection means 370 allows selection from the "alternate strike mode", the "simultaneous strike mode", and the "single piston strike mode" and also allows selection from a case of performing the "light strikes" with a stop position of the second piston 310 when operating in the "single piston strike mode" set at the back dead point and a case of performing the "small strikes" with the stop position set at the front dead point, the second striking mechanism stopping thrust adjustment means 390 in the ninth variation is a component for optimizing striking power of the "small strikes" according to a crushing target.

When control pressure from pilot control pressure sources OUTPP1 and OUTPP2 is supplied, a selection valve 371 and a control pressure switching valve 374 are respectively switched to switching ports at the upper positions in FIG. 10. This switch causes a second piston rear chamber 303 to be constantly connected to high pressure and a second piston 310 to push a transfer member 105 forward and stop. Thus, the two-piston hydraulic striking device 100*i* is brought to a state in which a first piston 210 strikes the transfer member 105 in a "small strike" manner at a position advanced beyond an impact point.

At this time, when the selection valve 391 is in a state illustrated in FIG. 10, that is, a state in which no control pressure from a pilot control pressure source OUTPP3 is supplied thereto, the selection valve 391 is set to a switching port at the upper position in FIG. 10. Since this setting causes the second striking mechanism operating pressure passage 307 to be connected to the high pressure circuit 101 via the branch passage 101*d*, forward thrust of the second piston 310 becomes maximum.

However, when the control pressure is supplied from the pilot control pressure source OUTPP3, the selection valve 391 is switched to a switching port at the lower position in FIG. 10. This switch causes the second striking mechanism operating pressure passage 307 to be connected to the high pressure circuit 101 via the reduced pressure passage 392, the decompression valve 393, and the check valve 394. This connection causes a second piston front chamber 302 and the second piston rear chamber 303 to be supplied with pressurized oil the pressure of which is reduced. While the second piston 310 is provided with forward thrust due to a pressure receiving area difference between the second piston front chamber 302 and the second piston rear chamber 303, the thrust is reduced when compared with a case where the second striking mechanism operating pressure passage 307 is connected to high pressure.

In the ninth variation, the setting of the decompression valve 393 is set in such a way that forward thrust of the second piston 310 becomes less intense than thrust of a feed mechanism. When a crushing target has a high strength and is stable, this setting causes the transfer member 105 to retract to a position at which the transfer member 105 comes into contact with a cylinder 301 as illustrated in FIG. 10 and the light strikes are performed as with a case where the second piston rear chamber 303 is connected to low pressure. On the other hand, when the crushing target is in a state where strength thereof is reduced due to cavities, a crushed zone, and the like, the second piston 310 advances pushing the transfer member 105 forward, which causes the small strikes to be performed.

Since, while the amount of pushing of the transfer member 105 varies according to a state of a crushing target, striking power of small strikes decreases as the amount of pushing increases, it is possible to perform small strikes suitable for a crushing target. Although, when drilling work is performed on a fragile crushing target with regular striking power, a so-called "bamboo shoot" state sometimes occurs in which drilling speed excessively increases to the extent that a flushing device cannot discharge cuttings thoroughly and the transfer member is thus stuck, the ninth variation enables striking power of small strikes to be optimized in accordance with a crushing target.

Tenth Variation

Figure 11:
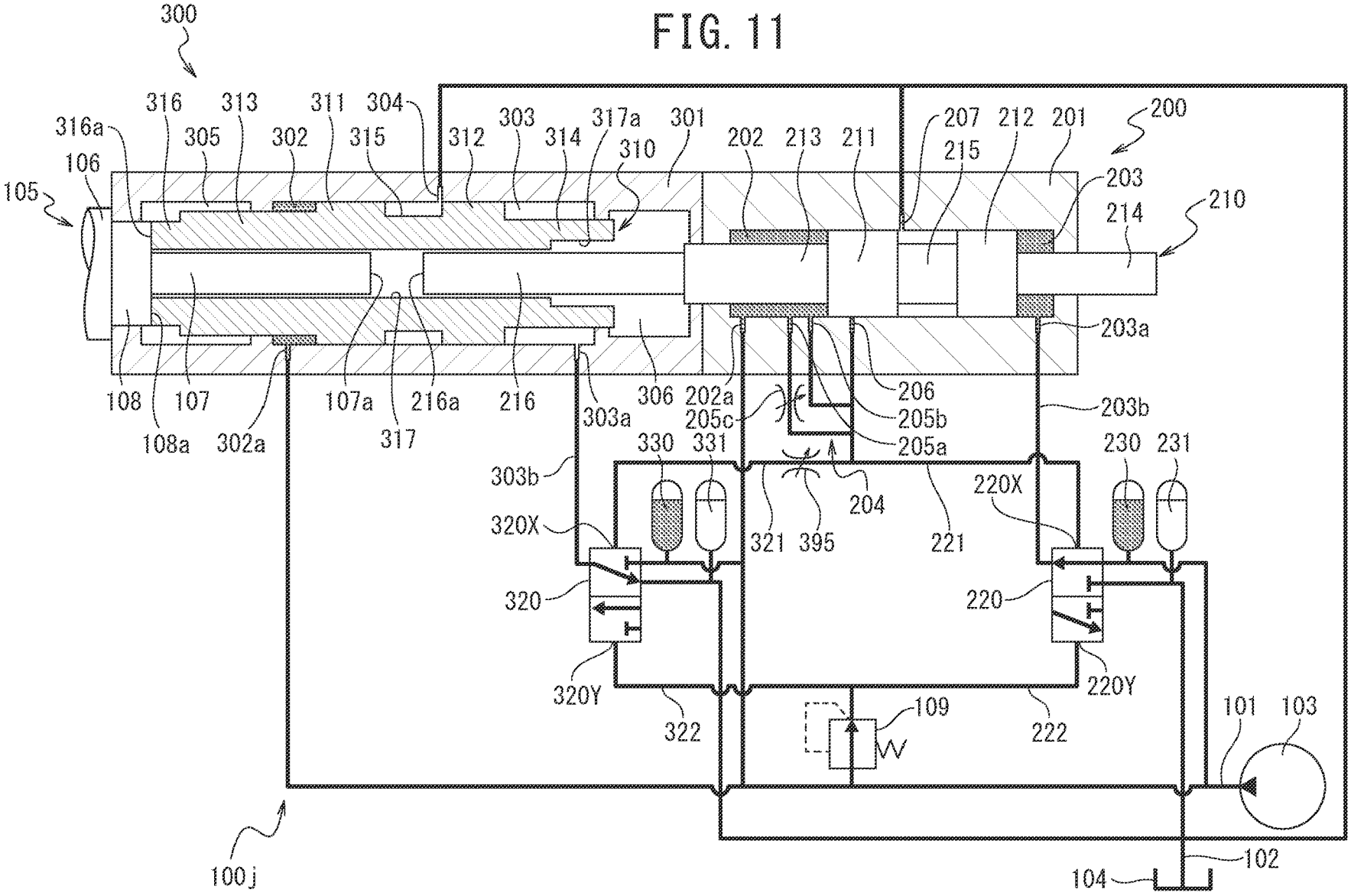
FIG. 11 is a longitudinal cross-sectional view of a tenth variation of the first embodiment.

FIG. 11 illustrates a two-piston hydraulic striking device 100*j* of a tenth variation. Note that the two-piston hydraulic striking device 100*j* of the tenth variation has a configuration in which an "adjustment means" is added to the configuration of the two-piston hydraulic striking device 100 of the first embodiment described above. That is, as illustrated in FIG. 11, a difference from the two-piston hydraulic striking device 100 of the first embodiment is that a variable choke 395 is disposed in a second switching valve control passage 321 as a second striking mechanism adjustment means. Operation of the variable choke 395 enables an adjustment of operation of a second striking mechanism 300.

Even when a state of striking by a first striking mechanism 200 and the second striking mechanism 300 relatively varies because, for example, a state of a crushing target and oil temperature change, the tenth variation can adjust the state of striking flexibly. This adjustment enables alternate strikes in which intervals between all successive strikes are temporally equally spaced to be performed when the two-piston hydraulic striking device 100*j* operates in the alternate strike mode and enables accurate simultaneous strikes to be performed when the two-piston hydraulic striking device 100*j* operates in the simultaneous strike mode.

Second Embodiment

Figure 12:
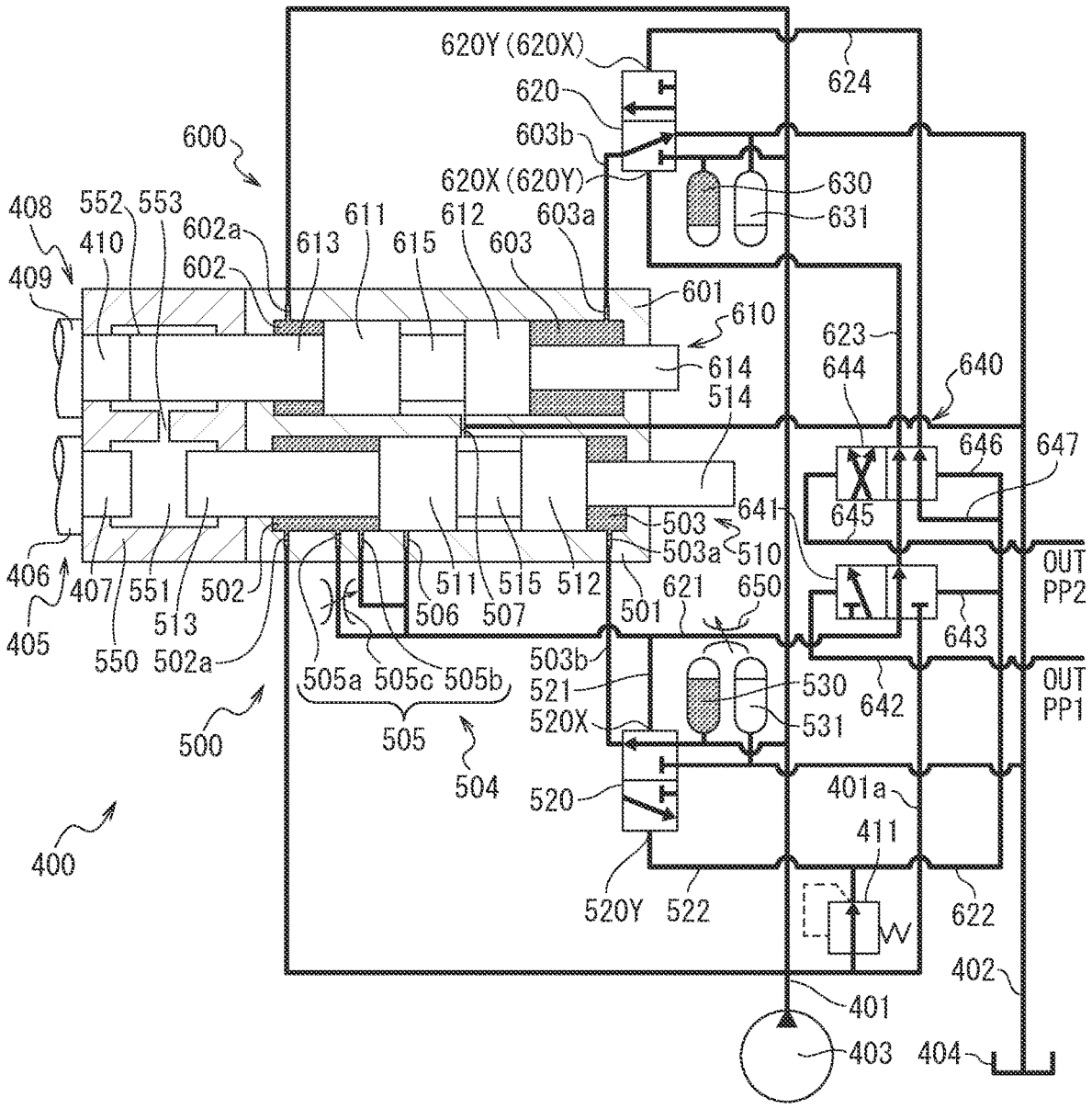
FIG. 12 is a longitudinal cross-sectional view of a second embodiment of the two-piston hydraulic striking device according to the one aspect of the present invention.

FIG. 12 illustrates a two-piston hydraulic striking device 400 of a second embodiment.

All the two-piston hydraulic striking devices according to the first embodiment and the first to tenth variations of the first embodiment, which were described with reference to FIGS. 1 to 11, are so-called tandem-type two-piston hydraulic striking devices in each of which the first striking mechanism 200 and the second striking mechanism 300 are arranged in series in the front and rear direction in such a way that the striking axes thereof are coaxial with each other and the second striking mechanism 300 is positioned on the side where the transfer member 105 is located, the second piston 310 has a hollow shape, the striking portions 216 and 316 that strike the transfer member 105 are disposed to tip portions of the first piston 210 and the second piston 310, respectively, and the first piston striking portion 216 is formed extended in such a way as to be inserted into the inside of the second piston 310 and to be able to strike the transfer member 105.

By contrast, the second embodiment illustrated in FIG. 12 is a so-called parallel-type two-piston hydraulic striking device 400 in which a first striking mechanism 500 and a second striking mechanism 600 are arranged in such a way that the striking axes thereof are parallel with each other and strike individual transfer members 405 and 408, respectively. Note that, in FIG. 12, the respective constituent components of the first striking mechanism 500 correspond to those of the first striking mechanism 200 in each of the first embodiment and the first to tenth variations and the respective constituent components of the second striking mechanism 600 also correspond to those of the second striking mechanism 300 in each of the first embodiment and the first to tenth variations except that a tandem-type arrangement is changed to a parallel-type arrangement, and a detailed description thereof will thus be omitted.

In the second embodiment, the two transfer members 405 and 408, which are arranged in parallel with each other, are held by one front head 550, and, in the front head 550, striking chambers 551 and 552 for the respective transfer members 405 and 408 are formed in parallel with each other. A second piston 610 has exactly the same specifications as a first piston 510. However, the two-piston hydraulic striking device 400 does not include the second striking mechanism stopping thrust adjustment means 390 in the ninth variation.

According to the second embodiment, in the parallel-type two-piston hydraulic striking device, the two striking mechanisms have the same cycle time and are easy to control and stable in operation. Since appropriate employment of a configuration similar to those of the first to tenth variations of the first embodiment enables any of an alternate strike mode, a simultaneous strike mode, and a single piston strike mode to be selected, coordination between operations of two striking mechanisms to be adjusted, and a stroke adjustment of the whole device to be performed, the parallel-type two-piston hydraulic striking device can flexibly cope with various types of work. Since accumulators are arranged in proximity to respective piston rear chambers, the parallel-type two-piston hydraulic striking device excels in striking efficiency. The parallel-type two-piston hydraulic striking device is effective for use in a drilling device for drilling a slotted hole.

Next, representing the embodiments and the respective variations described above, operation in the alternate strike mode using the two-piston hydraulic striking device 100*a* of the first variation will be described with reference to FIG. 2 and FIGS. 13A to 13F. Note that, in FIGS. 13A to 13F, a shaded area indicates that the area is in a state of being connected to high pressure and a blank area indicates that the area is in a state of being connected to low pressure. In this example, description will be made assuming a state in which the long stroke port 205*b* functions by setting the first piston advance control ports 205 so as to fully close the variable throttle 205*c*, that is, a state in which a long stroke is selected, in FIG. 2.

In the two-piston hydraulic striking device 100*a* of the first variation, immediately after the second piston 310 has struck the transfer member 105, the first piston 210 retracts and the long stroke port 205*b* comes into communication with the first piston front chamber 202. The valve control means 204 is connected to high pressure, and pilot ports of the first switching valve 220*a* and the second switching valve 320*a* are supplied with high pressure oil. The supply of the high pressure oil causes the first switching valve 220*a* and the second switching valve 320*a* to be respectively switched to switching ports at the upper positions in FIGS. 13A to 13F. This switch causes the first piston rear chamber 203 and the second piston rear chamber 303 to be connected to high pressure and low pressure, respectively, which causes the first piston 210 and the second piston 310 to come into a retraction deceleration phase and a retraction acceleration phase, respectively (FIG. 13A).

Next, the first piston 210 and the second piston 310 retract together, and the first piston 210 reaches the back dead point. Since, at this time, the valve control means 204 is maintained connected to high pressure, the first switching valve 220 and the second switching valve 320 are respectively held to the switching ports at the upper positions in FIGS. 13A to 13F. The first piston rear chamber 203 and the second piston rear chamber 303 are maintained connected to high pressure and low pressure, respectively, which causes the first piston 210 to turn to an advance acceleration phase and the second piston 310 to maintain the retraction acceleration phase (FIG. 13B).

Figures 13A, 13B, 13C, 13D, 13E, 13F:
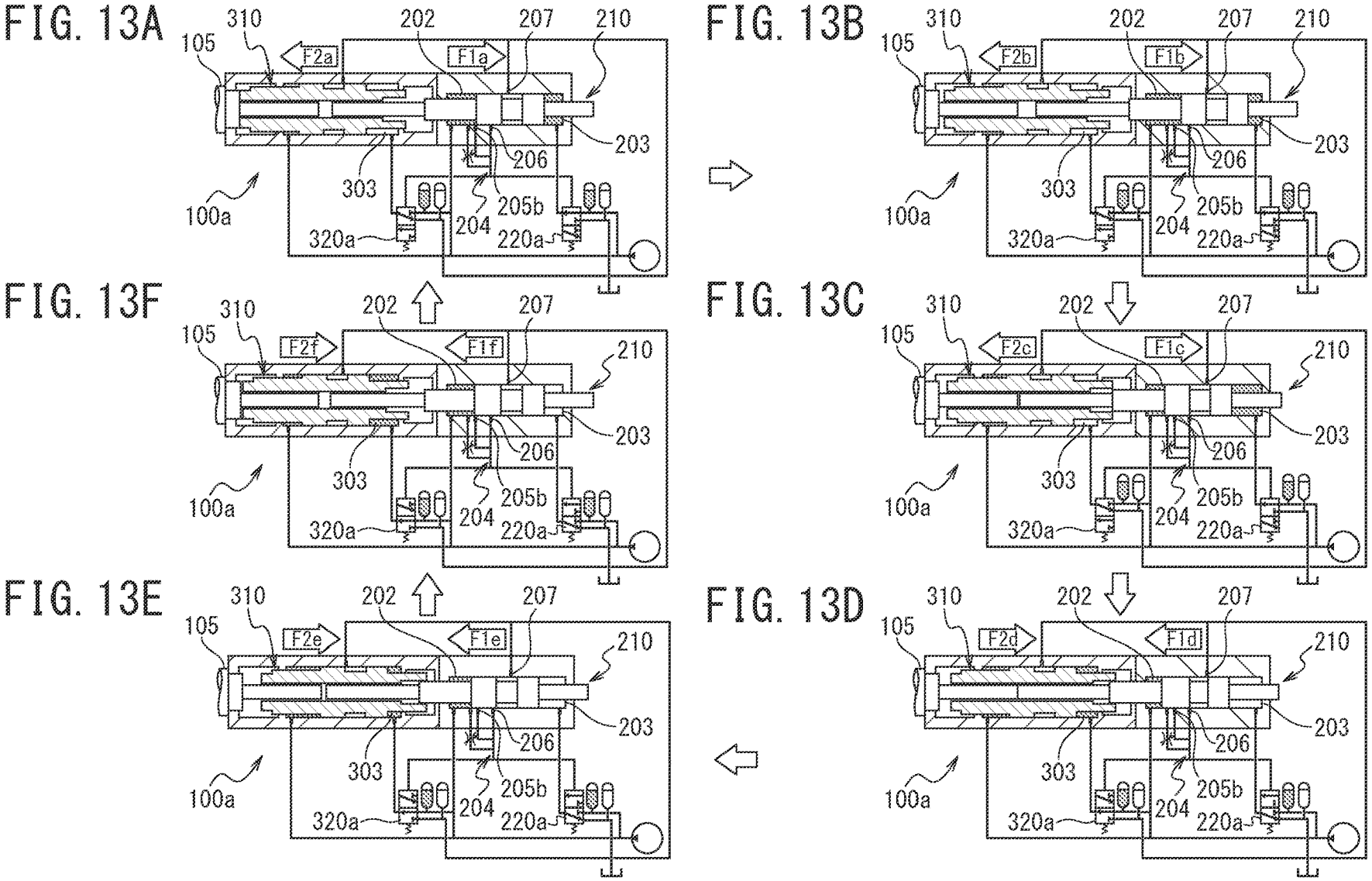
FIGS. 13A to 13F are operation explanatory diagrams of the first variation.
Figure 14:
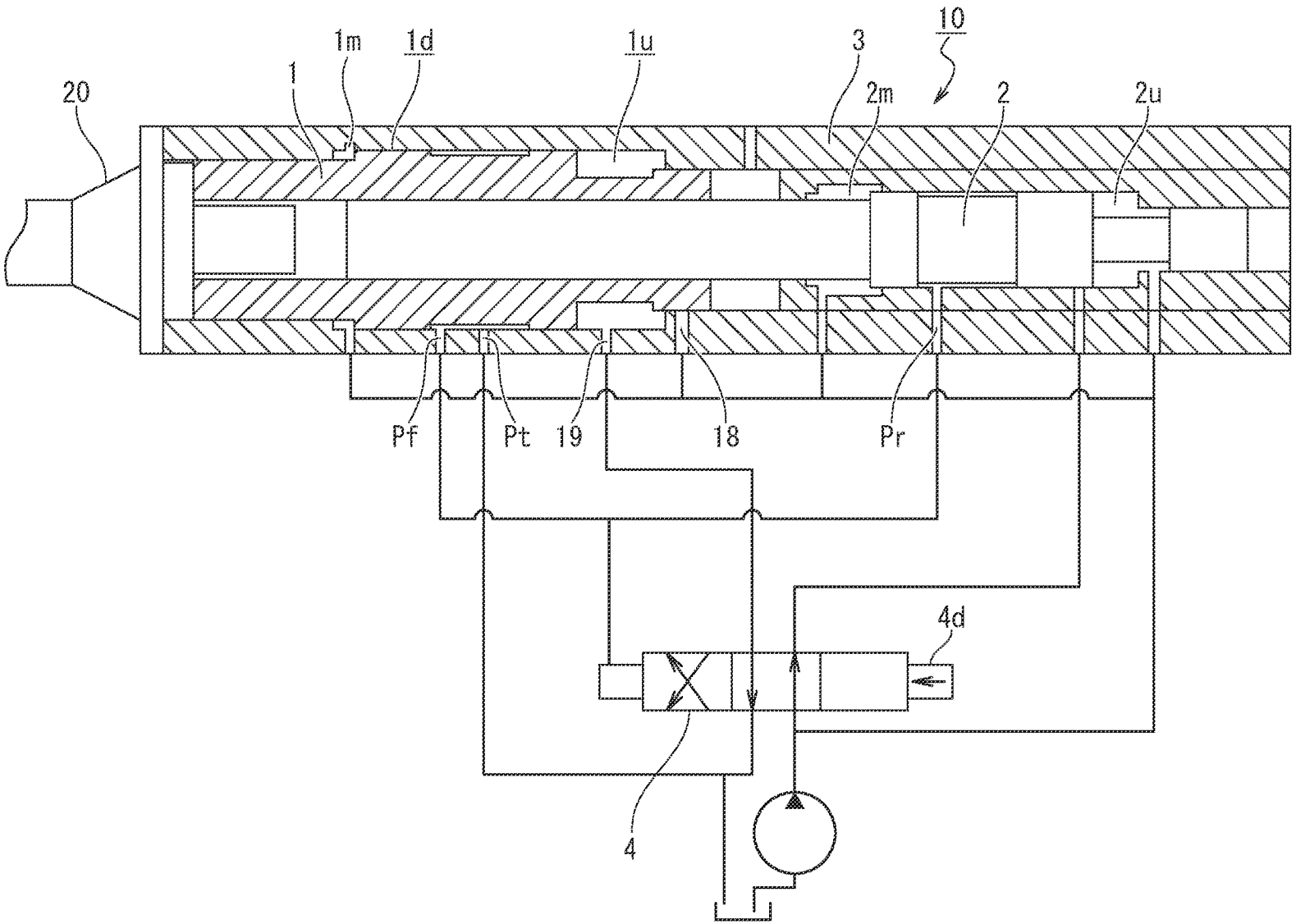
FIG. 14 is a longitudinal cross-sectional view illustrative of an example of a conventional two-piston hydraulic striking device.
Figure 15B:
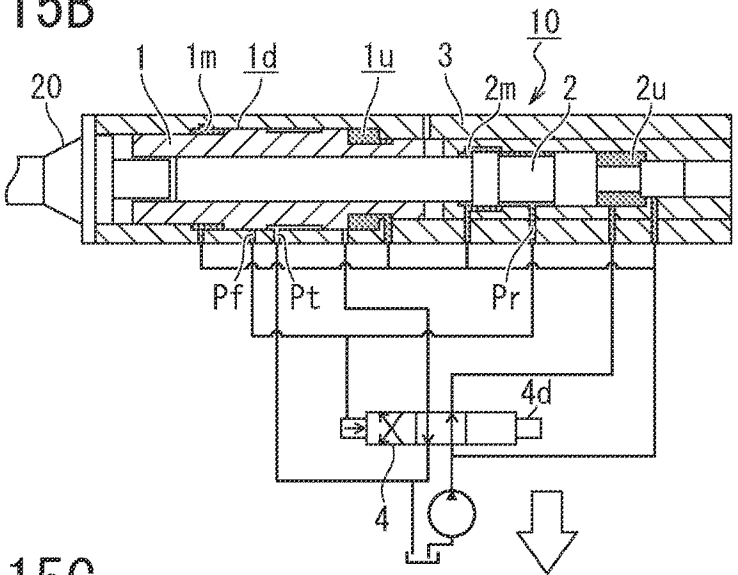
FIGS. 15A to 15D are operation explanatory diagrams of the conventional two-piston hydraulic striking device.
Figure 15A:
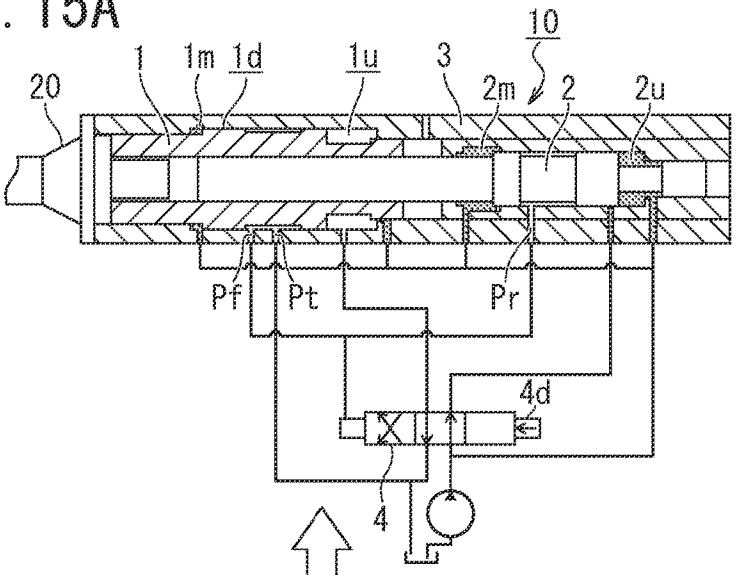
Figure 15C:
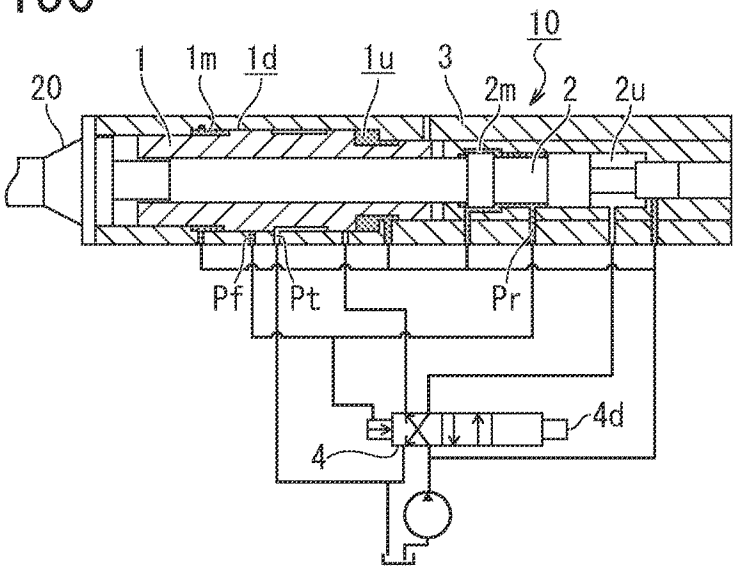
Figure 15D:
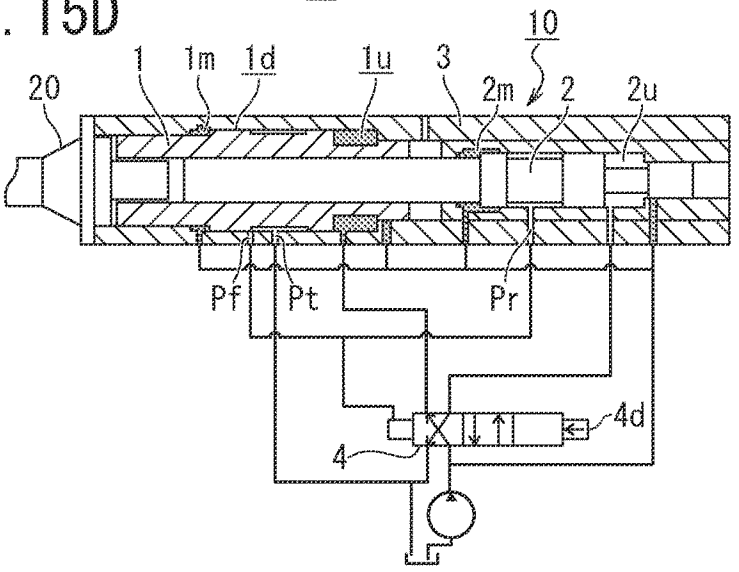

Next, since, while the first piston 210 advances to a position immediately before a position at which the first piston 210 strikes the transfer member 105 and the second piston 310 retracts, the valve control means 204 is maintained connected to high pressure, the first switching valve 220 and the second switching valve 320 are respectively held to the switching ports at the upper positions in FIGS. 13A to 13F. The first piston rear chamber 203 and the second piston rear chamber 303 are maintained connected to high pressure and low pressure, respectively, the first piston 210 is accelerated to around a maximum advancing speed, and the second piston 310 maintains the retraction acceleration phase (FIG. 13C).

Immediately after the first piston 210 has struck the transfer member 105, the first piston retraction control port 206 comes into communication with the first piston oil discharge port 207. The valve control means 204 is connected to low pressure, and the pilot ports of the first switching valve 220 and the second switching valve 320 are connected to low pressure. This connection causes the first switching valve 220 and the second switching valve 320 to be respectively switched to the switching ports at the lower positions in FIGS. 13A to 13F. This switch causes the first piston rear chamber 203 and the second piston rear chamber 303 to be connected to low pressure and high pressure, respectively, which causes the first piston 210 and the second piston 310 to turn to a retraction acceleration phase and a retraction deceleration phase, respectively (FIG. 13D).

Next, the first piston 210 and the second piston 310 retract together, and the second piston 310 reaches the back dead point. Since, at this time, the valve control means 204 is maintained connected to low pressure, the first switching valve 220 and the second switching valve 320 are respectively held to the switching ports at the lower positions in FIGS. 13A to 13F. The first piston rear chamber 203 and the second piston rear chamber 303 are maintained connected to low pressure and high pressure, respectively, which causes the first piston 210 to maintain the retraction acceleration phase and the second piston 310 to turn to an advance acceleration phase (FIG. 13E).

Since, while the second piston 310 advances to a position immediately before a position at which the second piston 310 strikes the transfer member 105 and the first piston 210 retracts, the valve control means 204 is maintained connected to low pressure, the first switching valve 220 and the second switching valve 320 are respectively held to the switching ports at the lower positions in FIGS. 13A to 13F. The first piston rear chamber 203 and the second piston rear chamber 303 are maintained connected to low pressure and high pressure, respectively, the second piston 310 is accelerated to around a maximum advancing speed, and the first piston 210 maintains the retraction acceleration phase (FIG. 13F). Thereafter, repeating the above-described cycle enables the first piston 210 and the second piston 310 to perform alternate strikes the transfer member 105 at equal temporal intervals.

When attention is focused on states of the piston front chambers and the piston rear chambers of the respective striking mechanisms in FIGS. 13A to 13C, the first striking mechanism 200 has high pressure in both the first piston front chamber 202 and the first piston rear chamber 203 and the second striking mechanism 300 has high pressure in the second piston front chamber 302 and low pressure in the second piston rear chamber 303.

Thus, while, in the first striking mechanism 200, forward thrust is produced on the first piston 210 and backward reaction forces F1*a* to F1*c* are exerted on the first cylinder 201, in the second striking mechanism 300, backward thrust is produced on the second piston 310 and forward reaction forces F2*a* to F2*c* are exerted on the second cylinder 301. That is, the reaction forces exerted on the first cylinder 201 and the reaction forces exerted on the second cylinder 301 have opposite directions, and the reaction forces thus offset each other.

Next, when attention is focused on states of the piston front chambers and the piston rear chambers of the respective striking mechanisms in FIGS. 13D to 13F, the first striking mechanism 200 has high pressure in the first piston front chamber 202 and low pressure in the first piston rear chamber 203 and the second striking mechanism 300 has high pressure in both the second piston front chamber 302 and the second piston rear chamber 303.

Thus, while, in the first striking mechanism 200, backward thrust is produced on the first piston 210 and forward reaction forces F1*d* to F1*f* are exerted on the first cylinder 201, in the second striking mechanism 300, forward thrust is produced on the second piston 310 and backward reaction forces F2*d* to F2*f* are exerted on the second cylinder 301. That is, the reaction forces exerted on the first cylinder 201 and the reaction forces exerted on the second cylinder 301 have opposite directions, and the reaction forces thus offset each other.

The reaction forces exerted on the respective striking mechanisms will be further considered.

When, in the first striking mechanism 200, the condition expressed by the formula 2 described afore is to be satisfied, that is, the sum of a retraction acceleration time of the first piston 210 and a retraction deceleration time of the first piston 210 is to be equalized with an advance time of the first piston 210, the pressure receiving area ratio between the front and rear of the first piston 210 is generally set at 1:4 in the case of a striking mechanism of a "front chamber constant high pressure and rear chamber high/low pressure switching type" of the present embodiment. Therefore, the pressure receiving area ratio between the front and rear of the second piston 310 is also required to be set at 1:4.

When the pressure receiving area ratios are set as described above, relations among the reaction forces F1*a* to F1*f* exerted on the first cylinder 201, the reaction forces F2*a* to F2*f* exerted on the second cylinder 301, and total reaction forces F0*a* to F0*f* obtained by totaling respective pairs of reaction forces in respective steps illustrated in FIGS. 13A to 13F are as given in the Table 1 below.

TABLE 1

| | F1 | F2 | F0 |
|---|---|---|---|
| FIG. 13A | −3 | +1 | −2 |
| FIG. 13B | −3 | +1 | −2 |
| FIG. 13C | −3 | +1 | −2 |
| FIG. 13D | +1 | −3 | −2 |
| FIG. 13E | +1 | −3 | −2 |
| FIG. 13F | +1 | −3 | −2 |

In the Table 1, a value of each reaction force is determined under the assumption that each of the reaction forces (F1*d* to F1*f*) takes a value of 1 when the first piston 210 accelerratingly retracts in the first cylinder 201 and takes a positive value when the direction of the reaction force is forward and a negative value when the direction is backward. As indicated in the Table 1, it is revealed that the total reaction forces F0*a* to F0*f* always take a value of −2 in all the steps.

For example, when it is assumed that a general hydraulic striking device includes only the first striking mechanism 200, reaction force exerted on the first cylinder varies in a range from −3 to +1. For this reason, a feed mechanism is required to be provided with a thrust greater than +3 in order to advance the first striking mechanism against a reaction force of −3. However, there is a step in which reaction force has a value of +1, and, in such a step, a thrust greater than +3 is excessive and causes a large load to be exerted on a rod, which is one of transfer members. Such a case sometimes becomes a cause for a bent hole or a damaged rod.

By contrast, in the two-piston hydraulic striking device 100 of the present invention, since, as described above, total reaction force is always kept at −2, it is only necessary to provide a feed mechanism with thrust greater than +2 and there never occurs a case where thrust becomes excessive and causes a bent hole or a damaged rod in some steps.

When the two-piston hydraulic striking device operates in the simultaneous strike mode, the first striking mechanism 200 and the second striking mechanism 300 exhibit the same behavior, and, when the two-piston hydraulic striking device operates in the single piston strike mode, only the first striking mechanism 200 operates, and a description of both modes will thus be omitted.

Although the embodiments and variations of the present invention were described above with reference to the accompanying drawings, the two-piston hydraulic striking device according to the present invention is not limited to the above-described embodiments and variations, and it should be understood that other various modifications and alterations to the respective constituent components can be made without departing from the spirit and scope of the present invention.

For example, although, in the embodiments and variations described above, an example in which the first piston 210 has a solid structure was described, the present invention is not limited to the example, and, as with the second piston 310, the first piston 210 may have a hollow structure. In this case, however, it is preferable that the end face of the first striking portion 107 of the transfer member 105, which faces the first piston striking portion 216, be provided with the same shape as that of the first piston striking portion 216.

Although, in the embodiments and variations described above, description was made using as an example a striking mechanism of a "front chamber constant high pressure and rear chamber high/low pressure switching type" in which the first striking mechanism 200 and the second striking mechanism 300 make their pistons advance and retract by constantly connecting the piston front chambers to high pressure and alternately switching connections of the piston rear chambers to high pressure and low pressure, the present invention is not limited to the example, and, when the same type of striking mechanism is employed for both striking mechanisms, a striking mechanism of a "front/rear chamber high/low pressure switching type" or a striking mechanism of a "rear chamber constant high pressure and front chamber high/low pressure switching type" may be employed (however, there is a case where the operation mode selection means and the operation stopping means cannot be employed depending on a type of a striking mechanism).

While, although, in the embodiments and variations described above, an example in which, in the second striking mechanism 300, the second piston 310 includes the second piston middle groove 315 and the second cylinder 301 includes the second piston oil discharge port 304 was described, such a configuration has meaning in preventing oil film shortage on sliding surfaces between the second piston large diameter portion (front) 311 and the second cylinder 301 and between the second piston large diameter portion (rear) 312 and the second cylinder 301, the second piston middle groove 315 and the second piston oil discharge port 304 may be eliminated when the problem of oil film shortage prevention can be resolved by an adjustment of the amount of clearance, and the like.

Although, in the embodiments and variations described above, the valve control means 204 is disposed to the first striking mechanism 200, the present invention is not limited to the configuration, and the valve control means 204 may be disposed to the second striking mechanism 300. The variable choke 395 described in the tenth variation may be disposed in the first switching valve control passage 221 or disposed in both the first switching valve control passage 221 and the second switching valve control passage 321.

Although, in the embodiments and variations described above, description was made assuming that the second striking mechanism operation mode selection means 350, which was exemplified as the circuit switching valve 355, the selection valve 381, and the three-position switching valve, was an electromagnetic valve, the present invention is not limited to the example, and a type of switching valve that is switched by pilot oil pressure by feeding control pressure via an another passage may be employed.

In the parallel-type two-piston hydraulic striking device in the second embodiment, two or more striking mechanisms may be arranged in parallel with one another, and, for example, a circumferential arrangement of a plurality of striking mechanisms enables a device for performing large diameter drilling to be achieved. In this case, in order to make the respective striking mechanism offset reaction forces of each other and constantly keep the total reaction force constant, it is preferable that an even number of striking mechanisms be arranged in parallel with one another.

A list of reference numbers in the drawings is described below.

100, 100*a* to 100*i* Two-piston hydraulic striking device (tandem)
101, 101*a* to 101*c* High pressure circuit, branch passage
102, 102*a* Low pressure circuit, branch passage
103 Pump
104 Tank
105 Transfer member
106 Large diameter portion (of transfer member)
107, 107*a* First striking portion, striking surface (of transfer member)
108, 108*a* Second striking portion, striking surface (of transfer member)
109 Decompression valve
200 First striking mechanism
201 First cylinder
202, 202*a* First piston front chamber, front chamber port
203, 203*a*, 203*b* First piston rear chamber, rear chamber port, rear chamber passage
204 Valve control means
205 First piston advance control port
205*a*, 205*b*, 205*c* Short stroke port, long stroke port, variable throttle
206 First piston retraction control port
207 First piston oil discharge port
210 First piston
211, 212 First piston large diameter portion (front), large diameter portion (rear)
213, 214, 215 First piston medium diameter portion, small diameter portion, switching groove
216, 216*a* First piston striking portion, striking surface
220 First switching valve (fully hydraulically actuated type)
220*a* First switching valve (spring return type)
220X, 220*a*X First switching valve control port
220Y, 220*a*Y First switching valve hold port
221, 222 First switching valve control passage, hold passage
230, 231 First high pressure accumulator, first low pressure accumulator
300 Second striking mechanism
301 Second cylinder
302, 302*a* Second piston front chamber, front chamber port
303, 303*a*, 303*b* Second piston rear chamber, rear chamber port, rear chamber passage
304 Second piston oil discharge port
305, 306 Striking chamber (front), striking chamber (rear)
307 Second striking mechanism operating pressure passage
310 Second piston
311, 312 Second piston large diameter portion (front), large diameter portion (rear)
313, 314, 315 Second piston medium diameter portion, small diameter portion, middle groove
316, 316*a* Second piston striking portion, striking surface
317, 317*a* Second piston bore, large diameter portion
320, 320*b* Second switching valve (fully hydraulically actuated type), same phase
320*a* Second switching valve (spring return type)
320X, 320*a*X, 320*b*X Second switching valve control port
320Y, 320*a*Y, 320*b*Y Second switching valve hold port
321, 321*a* to 321*d*, 323, 325, 326, 328 Second switching valve control passage
322, 324, 327 Second switching valve hold passage
330, 331 Second high pressure accumulator, second low pressure accumulator
350 Second striking mechanism operation mode selection means
351, 352, 353 Control pressure switching valve, control passage, hold passage
354 Second switching valve hold pressure supply passage
355 Second striking mechanism operation mode selection means (circuit switching valve)
360 Second striking mechanism stopping means
361, 362, 363 Selection valve, control passage, hold passage
370 Second striking mechanism operation mode selection means
371, 372, 373 Selection valve, control passage, hold passage
374, 375, 376 Control pressure switching valve, control passage, hold passage
377 Second switching valve hold pressure supply passage
380 Second striking mechanism stopping means
381 Selection valve

385 Second striking mechanism operation mode selection means (three-position switching valve)
390 Second striking mechanism stopping thrust adjustment means
391, 392, 393, 394 Selection valve, reduced pressure passage, decompression valve, check valve
395 Second striking mechanism adjustment means (variable choke)
400 Two-piston hydraulic striking device (parallel)
401, 401*a* High pressure circuit, branch passage
402 Low pressure circuit
403, 404 Pump, tank
405 First transfer member
406, 407 Large diameter portion, striking portion
408 Second transfer member
409, 410 Large diameter portion, strike portion
411 Decompression valve
500 First striking mechanism
501 First cylinder
502, 502*a* First piston front chamber, front chamber port
503, 503*a*, 503*b* First piston rear chamber, rear chamber port, rear chamber passage
504 Valve control means
505 First piston advance control port
505*a*, 505*b*, 505*c* Short stroke port, long stroke port, variable throttle
506 First piston retraction control port
507 First piston oil discharge port
510 First piston
511, 512 First piston large diameter portion (front), large diameter portion (rear)
513, 514, 515 First piston medium diameter portion, small diameter portion, switching groove
520, 521, 522 First switching valve, control passage, hold passage
520X, 520Y First switching valve control port, hold port
530, 531 First high pressure accumulator, low pressure accumulator
550 Front head
551, 552, 553 First striking chamber, second striking chamber, communication hole
600 Second striking mechanism
601 Second cylinder
602, 602*a* Second piston front chamber, front chamber port
603, 603*a*, 603*b* Second piston rear chamber, rear chamber port, rear chamber passage
610 Second piston
611, 612 Second piston large diameter portion (front), large diameter portion (rear)
613, 614, 615 Second piston medium diameter portion, small diameter portion, middle groove
620 Second switching valve
620X, 620Y Second switching valve control port, hold port
621, 623 Second switching valve control passage
622, 624 Second switching valve hold passage
630, 631 Second high pressure accumulator, low pressure accumulator
640 Second striking mechanism operation mode selection means
641, 642, 643 Selection valve, control passage, hold passage
644, 645, 646 Control pressure switching valve, control passage, hold passage
647 Second switching valve hold pressure supply passage
650 Second striking mechanism adjustment means (variable choke)
OUTPP External control pressure

The invention claimed is:

1. A two-piston hydraulic striking device comprising:

a striking mechanism configured to strike one transfer member with two pistons, wherein the striking mechanism includes a first striking mechanism and a second striking mechanism, and the first striking mechanism and the second striking mechanism are arranged in series in front and rear direction in such a way that striking axes are coaxial with each other and the second striking mechanism is positioned on a side where the one transfer member is located, the first striking mechanism includes: a first cylinder; a first piston configured to be slidably fitted into the first cylinder in such a manner as to be able to advance and retract, the first piston having a first striking portion for striking the one transfer member at a tip portion of the first piston; and a first switching valve configured to switch advancing and retracting movements of the first piston, the second striking mechanism includes:

a second cylinder; a second piston configured to be slidably fitted into the second cylinder in such a manner as to be able to advance and retract, the second piston having a second striking portion for striking the one transfer member at a tip portion of the second piston; and a second switching valve configured to switch advancing and retracting movements of the second piston, only either the first striking mechanism or the second striking mechanism includes a valve controller for controlling operation of both the first switching valve and the second switching valve, of the two pistons, at least the second piston is formed into a hollow shape and the first piston is inserted into inside of the second piston in such a way that the first striking portion extends in such a manner as to be able to strike the one transfer member, and a pressure receiving area ratio between front and rear of the first piston and a pressure receiving area ratio between front and rear of the second piston are set to satisfy a formula below:

$$[t1a+t1c]=t1b=[t2a+t2c]=t2b \quad \text{(Formula)},$$

where t1a, t1b, t1c, t2a, t2b, and t2c represent an advance time of the first piston, a retraction acceleration time of the first piston, a retraction deceleration time of the first piston, an advance time of the second piston, a retraction acceleration time of the second piston, and a retraction deceleration time of the second piston, respectively, the first piston has a first piston medium diameter portion, a first piston small diameter portion, and a first piston large diameter portion formed between the first piston medium diameter portion and the first piston small diameter portion, the second piston has a second piston medium diameter portion, a second piston small diameter portion, and a second piston large diameter portion formed between the second piston medium diameter portion and the second piston small diameter portion, the pressure receiving area ratio of the first piston is a ratio between a difference between a cross-sectional area of the first piston large diameter portion and a cross-sectional area of the first piston medium diameter portion and a difference between the cross-sectional area of the first piston large diameter portion and a cross-sectional area of the first piston small diameter portion, and the pressure receiving area ratio of the second piston is a ratio between a difference between a cross-sectional area of the second piston large diameter portion and a cross-sectional area of the second piston medium diameter portion and a difference between the cross-sectional area of the second piston large diameter portion and a cross-sectional area of the second piston small diameter portion.

2. The two-piston hydraulic striking device according to claim 1, wherein the striking mechanisms are configured in such a manner as to be able to set an alternate strike mode in which the two pistons alternately strike the one transfer member, and the alternate strike mode is a mode in which a switching port of the first switching valve and a switching port of the second switching valve are set in such a way as to have opposite phases to each other and the first striking mechanism and the second striking mechanism operate in such a way as to alternately strike the one transfer member at equal temporal intervals.

3. The two-piston hydraulic striking device according to claim 1, wherein the striking mechanisms are configured in such a manner as to be able to set a simultaneous strike mode in which the two pistons simultaneously strike the one transfer member, and the simultaneous strike mode is a mode in which a switching port of the first switching valve and a switching port of the second switching valve are set in such a way as to have a same phase as each other and the first striking mechanism and the second striking mechanism operate in such a way as to simultaneously strike the one transfer member.

4. The two-piston hydraulic striking device according to claim 1, wherein the striking mechanisms have, at either the first switching valve or the second switching valve, an operation mode selector for selecting an alternate strike mode or a simultaneous strike mode by switching phases of a switching port of each switching valve, the alternate strike mode is a mode in which the two pistons alternately strike the one transfer member, and the simultaneous strike mode is a mode in which the two pistons simultaneously strike the one transfer member.

5. The two-piston hydraulic striking device according to claim 4, wherein at least a switching valve that is controlled by the operation mode selector is a fully hydraulically actuated pilot control valve that includes a control port configured to be supplied with control pressure and a hold port configured to be supplied with hold pressure from the valve controller, and the operation mode selector includes a control pressure switching valve configured to switch phases of the switching port by switching arrangements of the control port and the hold port.

6. The two-piston hydraulic striking device according to claim 4, wherein the operation mode selector includes a circuit switching valve configured to switch phases of the switching port by switching circuit configurations of a high pressure circuit and a low pressure circuit that are connected to a switching valve that is controlled by the operation mode selector.

7. The two-piston hydraulic striking device according to claim 1, wherein either one of the first switching valve and the second switching valve has a stopper for stopping operation of the either one of the first switching valve and the second switching valve by cutting off a connection between the valve controller and a control port of the either one of the first switching valve and the second switching valve and is configured in such a manner as to be able to select a single piston strike mode in which striking is performed by either the first striking mechanism or the second striking mechanism.

8. The two-piston hydraulic striking device according to claim 7, wherein the stopper has a selection valve configured to switch stop positions of the either one of the first switching valve and the second switching valve in such a way as to maintain a piston rear chamber of a striking mechanism to be stopped at either high pressure or low pressure.

9. The two-piston hydraulic striking device according to claim 8, wherein the stopper has a stopping thrust adjuster for, when the striking mechanism to be stopped is stopped with a piston rear chamber of the striking mechanism connected to high pressure, adjusting pressure in the piston rear chamber of the striking mechanism to be stopped in such a way that forward thrust of a piston of the striking mechanism to be stopped is less than or equal to thrust of a feed mechanism.

10. The two-piston hydraulic striking device according to claim 1, wherein mass of the first piston and mass of the second piston are set to be a same value.

11. The two-piston hydraulic striking device according to claim 1, wherein at at least a point in control passages of the first switching valve and the second switching valve, an adjuster for adjusting operation speed of a switching valve is disposed.

12. The two-piston hydraulic striking device according to claim 1, wherein the valve controller includes a first piston advance control port configured to communicate a high pressure circuit with a valve control passage in association with a retraction of the first piston, and a first piston retraction control port configured to communicate a low pressure circuit with the valve control passage in association with an advance of the first piston, and a stroke adjustment mechanism is disposed to the first piston advance control port.

13. The two-piston hydraulic striking device according to claim 1, wherein each of the first striking mechanism and the second striking mechanism includes a high pressure accumulator and a low pressure accumulator.

14. The two-piston hydraulic striking device according to claim 1, wherein the valve controller includes a first piston advance control port configured to communicate a high pressure circuit with a valve control passage in association with a retraction of the first piston, and a first piston retraction control port configured to communicate a low pressure circuit with the valve control passage in association with an advance of the first piston, and a stroke adjustment mechanism is disposed to the first piston advance control port.

15. A two-piston hydraulic striking device comprising:

a striking mechanism configured to strike one or a plurality of transfer members with two pistons, wherein the striking mechanism includes a first striking mechanism and a second striking mechanism, and the first striking mechanism and the second striking mechanism are arranged in such a way that striking axes are in parallel with each other, the first striking mechanism includes: a first cylinder; a first piston configured to be slidably fitted into the first cylinder in such a manner as to be able to advance and retract, the first piston having a first striking portion for striking the one or the plurality of transfer members at a tip portion of the first piston; and a first switching valve configured to switch advancing and retracting movements of the first piston, the second striking mechanism includes: a second cylinder; a second piston configured to be slidably fitted into the second cylinder in such a manner as to be able to advance and retract, the second piston having a second striking portion for striking the one or the plurality of transfer members at a tip portion of the second piston; and a second switching valve configured to switch advancing and retracting movements of the second piston, only the first striking mechanism includes a valve controller for controlling operation of both the first switching valve and the second switching valve, and a pressure receiving area ratio between front and rear of the first piston and a pressure receiving area ratio between front and rear of the second piston are set to satisfy a formula below:

$$[t1a+t1c]=t1b=[t2a+t2c]=t2b \quad \text{(Formula)},$$

where t1a, t1b, t1c, t2a, t2b, and t2c represent an advance time of the first piston, a retraction acceleration time of the first piston, a retraction deceleration time of the first piston, an advance time of the second piston, a retraction acceleration time of the second piston, and a retraction deceleration time of the second piston, respectively, the first piston has a first piston medium diameter portion, a first piston small diameter portion, and a first piston large diameter portion formed between the first piston medium diameter portion and the first piston small diameter portion, the second piston has a second piston medium diameter portion, a second piston small diameter portion, and a second piston large diameter portion formed between the second piston medium diameter portion and the second piston small diameter portion, the pressure receiving area ratio of the first piston is a ratio between a difference between a cross-sectional area of the first piston large diameter portion and a cross-sectional area of the first piston medium diameter portion and a difference between the cross-sectional area of the first piston large diameter portion and a cross-sectional area of the first piston small diameter portion, and the pressure receiving area ratio of the second piston is a ratio between a difference between a cross-sectional area of the second piston large diameter portion and a cross-sectional area of the second piston medium diameter portion and a difference between the cross-sectional area of the second piston large diameter portion and a cross-sectional area of the second piston small diameter portion.

16. The two-piston hydraulic striking device according to claim 15, wherein each of the first striking mechanism and the second striking mechanism includes a high pressure accumulator and a low pressure accumulator.

17. The two-piston hydraulic striking device according to claim 15, wherein mass of the first piston and mass of the second piston are set to be a same value.

18. The two-piston hydraulic striking device according to claim 15, wherein at at least a point in control passages of the first switching valve and the second switching valve, an adjuster for adjusting operation speed of a switching valve is disposed.

19. The two-piston hydraulic striking device according to claim 15, wherein either one of the first switching valve and the second switching valve has a stopper for stopping operation of the either one of the first switching valve and the second switching valve by cutting off a connection between the valve controller and a control port of the either one of the first switching valve and the second switching valve and is configured in such a manner as to be able to select a single piston strike mode in which striking is performed by either the first striking mechanism or the second striking mechanism.

20. The two-piston hydraulic striking device according to claim 19, wherein the stopper has a selection valve configured to switch stop positions of the either one of the first switching valve and the second switching valve in such a way as to maintain a piston rear chamber of a striking mechanism to be stopped at either high pressure or low pressure.

* * * * *